US007024125B2

(12) United States Patent
Ishii et al.

(10) Patent No.: US 7,024,125 B2
(45) Date of Patent: Apr. 4, 2006

(54) CHARGING DEVICE AND IMAGE FORMING APPARATUS

(75) Inventors: Yasutomo Ishii, Ebina (JP); Koya Tanaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 65 days.

(21) Appl. No.: 10/716,409

(22) Filed: Nov. 20, 2003

(65) Prior Publication Data

US 2004/0258430 A1 Dec. 23, 2004

(30) Foreign Application Priority Data

Jun. 20, 2003 (JP) ..... 2003-177121
Jun. 20, 2003 (JP) ..... 2003-177122

(51) Int. Cl.
*G03G 15/02* (2006.01)
*G03G 15/00* (2006.01)

(52) U.S. Cl. ..... 399/50; 399/89

(58) Field of Classification Search ..... 399/44, 399/50, 88, 89, 90, 94, 97, 101; 250/325; 361/225

See application file for complete search history.

(56) References Cited

U.S. PATENT DOCUMENTS 4,026,648 A * 5/1977 Takahashi ..... 399/101
5,420,671 A * 5/1995 Kisu et al. ..... 399/50 X
5,499,080 A * 3/1996 Furuya et al. ..... 399/50
5,737,663 A * 4/1998 Handa et al. ..... 399/50
5,749,022 A * 5/1998 Kikui et al. ..... 399/50
5,812,905 A * 9/1998 Yoo ..... 399/50
5,842,081 A * 11/1998 Kaname et al. ..... 399/50
5,974,277 A * 10/1999 Yamane et al. ..... 399/50
6,118,952 A * 9/2000 Furuya ..... 399/50
6,385,409 B1 * 5/2002 Suzuki et al. ..... 399/44 X
6,668,143 B1 * 12/2003 Ito ..... 399/44
6,744,994 B1 * 6/2004 Yoshikawa et al. ..... 399/44
6,782,215 B1 * 8/2004 Komori ..... 399/50

FOREIGN PATENT DOCUMENTS

JP 1-267667 10/1989
JP 9-185219 7/1997
JP 10-232534 9/1998

* cited by examiner

*Primary Examiner*—Sandra L. Brase
(74) *Attorney, Agent, or Firm*—Morgan Lewis & Bockius LLP

(57) ABSTRACT

The present invention is a charging device that electrically charges an object that is charged while being moved in a predetermined direction and an image forming device having such a charging device. The charging device has: a charging member that electrically charges the charged object; a power source that supplies electric power to the charging member in order to electrically charge the charged object; a contact member arranged downstream relative to the charging member as viewed in the moving direction of the charged object and adapted to contact the charged object directly or by way of a predetermined intermediary medium; an ammeter that gauges an electric current caused to flow through the contact member due to an electric charge on the charged object electrically charged by the charging member; and a power source control section that controls the power source based on the electric current gauged by the ammeter.

23 Claims, 20 Drawing Sheets

CHARGING DEVICE AND IMAGE FORMING APPARATUS

BACKGROUND OF THE INVENTION

1. Field of the Invention

This invention relates to a charging device for electrically charging a charged object adapted to be electrically charged while moving in a predetermined direction. It also relates to an image forming apparatus having such a charging device.

2. Related Background Art

Conventionally, in image forming apparatus such as copying machines and printers to which an electrophotography process is applied, an image is formed on a recording medium by electrically charging the surface of a revolving photosensitive body by means of a charging device, exposing the surface of the photosensitive body to light to form an electrostatic latent image on the surface thereof, developing the electrostatic latent image to produce a developed visible image by applying a developing agent, transferring the developed image onto a recording medium such as a sheet of recording paper and fixing the transferred image. Available charging devices employ either a contact charging method or a non-contact charging method. With the contact charging method, an electrically conductive member, which is in fact semiconductor, is arranged as charging member on the surface of the photosensitive body that is the charged object so as to contact the photosensitive body and the photosensitive body is electrically charged by applying a voltage to the charging member and causing electric discharges to take place in micro-gaps near the contact areas. With the non-contact charging method, on the other hand, an electrically conductive member, which is in fact semiconductor, is arranged as charging member near the surface of the photosensitive body that is the charged object but separated from the photosensitive body and the photosensitive body is electrically charged by applying a voltage to the charging member and causing corona discharges to take place.

With either charging method, it is necessary to electrically charge the surface of the photosensitive body so as to make it show a uniform electric potential in order to obtain a good image. Particularly in the case of the contact charging method, it is effective to apply a charged bias voltage obtained by combining a DC component and an AC component to the charging member from the viewpoint of preventing the surface of the photosensitive body from being unevenly charged as a result of voltage application. However, when a voltage obtained by superimposing an AC component on a DC component is applied, there arises a problem that the number of times of ion collisions at the surface of the photosensitive body increases to quickly degrade the photosensitive body rather than when a voltage obtained only by using a DC component is applied without superimposing an AC component. There also arises a problem that the volume of the discharge products adhering to the surface of the photosensitive body also increases. The discharge products adhering to the surface of the photosensitive body obstruct the exposure to light of the image to give rise to defective images called deletion (white space on a colored background).

It is known that these problems become remarkable particularly when the inter-peak voltage Vpp of the AC component that is superimposed on the DC component is large. On the other hand, uneven electric discharges occur when the inter-peak voltage Vpp is too small. For this reason, it is preferable that the lowest voltage that provides uniform electric discharges (to be referred to as discharge triggering voltage Vth hereinafter) is selected as inter-peak voltage Vpp for the AC component and superimposing such an AC component on the DC component. However, the discharge triggering voltage Vth can easily be influenced by changes in the environment including those of temperature and humidity, changes in the electric resistance of the charging member that can be caused by dirt and changes in the state of the surface of the photosensitive body that occur as a function of time in service. In other words, it can vary remarkably. Therefore, the inter-peak voltage Vpp needs to be defined with a wide margin. In reality, a value much higher than the discharge triggering voltage Vth is inevitably selected for the inter-peak voltage Vpp to allow excessive electric discharges to occur between the charging member and the surface of the photosensitive body. Thus, the problem of early degradation of the photosensitive body and that of defective images due to discharge products are still remarkable.

In an attempt for suppressing excessive electric discharges as much as possible, there has been proposed a technique of applying a charged bias voltage obtained by superimposing an AC voltage on a DC voltage and controlled for a constant electric current (see Patent Document 1 listed below). However, the proposed technique can only reduce variances in the discharge triggering voltage Vth and does not drastically dissolve the problems. As an improvement to the technique of Patent Document 1, there has been proposed a technique of selecting a lower value for the inter-peak voltage Vpp by observing the electric current of the AC component when applying a charged bias voltage to the charging member and detecting excessive electric discharges from minute fluctuations of the observed electric current of the AC component (see Patent Document 2 listed below). However, it is indispensable for the technique of Patent Document 2 to detect minute fluctuations of the electric current, which is an extremely difficult job, and the problems as pointed out above arise when such fluctuations are missed. There has also been proposed a technique of directly observing the electric potential of the surface of the photosensitive body for the purpose of selecting a lower value for the inter-peak voltage Vpp (Patent Document 3). However, a device for directly observing the electric potential of the surface of a photosensitive body can hardly be made compact and hence such a technique cannot be employed in an image forming apparatus that needs to be down-sized.

[Patent Document 1]

Japanese Patent Application Laid-Open Publication No. 1-267667

[Patent Document 2]

Japanese Patent Application Laid-Open Publication No. 10-232534

[Patent Document 3]

Japanese Patent Application Laid-Open Publication No. 9-185219

SUMMARY OF THE INVENTION

The present invention has been made in view of the above circumstances and provides a charging device that can suppress excessive electric discharges and uniformly charge a charged object and also an image forming apparatus having such a charging device.

In an aspect of the present invention, the above object is achieved by providing a charging device that electrically charges a charged object charged while being moved in a predetermined direction having:

a charging member that electrically charges the charged object;

a power source that supplies electric power to the charging member in order to electrically charge the charged object;

a contact member arranged downstream relative to the charging member as viewed in the moving direction of the charged object and adapted to contact the charged object directly or by way of a predetermined intermediary medium;

an ammeter that gauges the electric current caused to flow through the contact member due to an electric charge on the charged object electrically charged by the charging member; and a power source control section that controls the power source on the basis of the electric current gauged by the ammeter.

Thus, with a charging device of the present invention, it is a direct current that is caused to flow through the contact member due to the electric charge on the charged object electrically charged by the charging member and is necessary for controlling the power source. Therefore, it is no longer necessary to detect minute fluctuations of the electric current value of the AC component and directly gauge the electric potential of the surface of the charged object so that the cost of the device can be reduced. Additionally, since the electric current is caused to flow due to the electric charge on the charged object, it is correlated with the electric potential of the surface of the charged object. Thus, as the power source control section controls the power source on the basis of the electric current, it is possible to suppress excessive electric discharges and realize an electrically uniform charging.

Further, in a charging device of the present invention, the power source may be adapted to supply the charging member with electric power showing a voltage waveform obtained by superimposing an AC voltage on a DC voltage. Therefore, an electrically more uniform charging can be realized as a result of superimposing an AC voltage.

In addition, in a charging device of the present invention, the power source control section may be adapted to control the electric current of the AC component supplied to the charging member by the power source on the basis of the electric current gauged by the ammeter.

In a charging device of the present invention, it is also preferable that the power source is adapted to supply the charging member with electric power showing a voltage waveform produced by superimposing an AC voltage on the DC voltage; and the power source control section is adapted to control an inter-peak voltage of the AC voltage being supplied by the power source to the charging member according to the electric current gauged by the ammeter.

Additionally, the problem that the charged object is degraded quickly as a result of superimposing an AC voltage and the problem that discharge products increases are minimized as the power source control section controls the inter-peak voltage of the AC voltage.

Preferably, in a charging device of the present invention, the power source is a constant current source from the viewpoint of realizing an electrically more uniform charging.

In a charging device of the present invention, the charging member may be a contact charging member adapted to electrically charge the charged object in a state where it contacts the charged object.

Furthermore, in a charging device of the present invention, it is also preferable that the power source supplies electric power showing a voltage waveform obtained by superimposing an AC voltage on a DC voltage to the charging member;

the charged object has a characteristic that the charged voltage rises substantially linearly to a predetermined inter-peak threshold voltage as the inter-peak voltage of the AC voltage increases and remains substantially at a constant level when the inter-peak voltage of the AC voltage exceeds the predetermined inter-peak threshold voltage; and the power source control section detects the inter-peak threshold voltage on the basis of the electric current gauged by the ammeter and controls the AC voltage being superimposed on the DC voltage of the power source on the basis of the inter-peak threshold voltage.

With the above feature of the device of the present invention, the margin that has to be given to the inter-peak threshold voltage when controlling the DC voltage so that the inter-peak voltage of the AC voltage can be held low if compared with a comparable conventional device with which firstly a lowest possible inter-peak threshold voltage at which electric discharges take place uniformly on a stable basis is detected and the AC voltage that is superimposed on the DC voltage of the power source is controlled according to the detected inter-peak threshold voltage. Therefore, it is now possible to suppress excessive electric discharges and realize an electrically more uniform charging. As a result, the charged object is prevented from becoming degraded due to electric discharges and adherence of discharge products to the charged object is minimized.

Alternatively, in a charging device of the present invention, it is preferable that the power source control section determines the above inter-peak threshold voltage on the basis of at least three electric current values including the first and the second electric current values each of which acquired by sequentially superimposing on the predetermined DC voltage at least two AC voltages showing respective peak voltages that are lower than the inter-peak threshold voltage and different from each other and gauging the electric current values by means of the ammeter when the AC voltages are superimposed and the third electric current value acquired by superimposing on the predetermined DC voltage at least an AC voltage showing an inter-peak voltage exceeding the above inter-peak threshold voltage and gauging the electric current value by means of the ammeter.

With this arrangement, the inter-peak threshold voltage can be detected in a short period of time.

Further, in a charging device of the present invention, when the power source control section acquires an electric current value by superimposing on the predetermined DC voltage an AC voltage showing an inter-peak voltage exceeding the above inter-peak threshold voltage and gauging the electric current value by means of the ammeter, it may determine the inter-peak threshold voltage while gradually lowering the inter-peak voltage.

In a charging device of the present invention, when the power source control section acquires an electric current value by superimposing on the predetermined DC voltage an AC voltage showing an inter-peak voltage that is lower than the inter-peak threshold voltage and gauging the electric current value by means of the ammeter, it may determine the inter-peak threshold voltage while gradually raising the inter-peak voltage.

In an aspect of the present invention, the above object is achieved by providing an image forming apparatus to form a fixed toner image on a recording medium by way of a process of electrically charging a photosensitive body being moved in a predetermined moving direction and producing an electrostatic latent image on the photosensitive body when being exposed to light so as to carry a toner image as a result of developing the electrostatic latent image and ultimately by transferring the toner image onto the recording medium and fixing the transferred image;

the image forming apparatus having:

a charging member that electrically charges the photosensitive body;

a power source that supplies electric power to the charging member in order to electrically charge the photosensitive body;

a contact member arranged downstream relative to the charging member as viewed in the moving direction of the photosensitive body and adapted to contact the photosensitive body directly or by way of a predetermined intermediary medium;

an ammeter that gauges an electric current caused to flow through the contact member due to the electric charge on the photosensitive body electrically charged by the charging member and moved to the position contacting the contact member without effectuating exposure and development; and a power source control section that controls the power source on the basis of the electric current gauged by the ammeter.

In addition, in an image forming apparatus of the present invention, it is preferable that the power source supplies electric power showing a voltage waveform obtained by superimposing an AC voltage on a DC voltage to the charging member; or the power source control section controls the electric current of the AC component supplied to the charging member by the power source on the basis of the electric current gauged by the ammeter.

More preferably, in an image forming apparatus of the present invention, the power source is adapted to supply electric power showing a voltage waveform obtained by superimposing an AC voltage on a DC voltage to the charging member; and the power source control section is adapted to control the inter-peak voltage of the AC voltage being supplied by the power source to the charging member on the basis of the electric current gauged by the ammeter.

Furthermore, an image forming apparatus of the present invention may have an environment detection unit for detecting the temperature and the humidity of the surroundings of the photosensitive body; and the power source control section is adapted to amend the inter-peak voltage on the basis of the temperature and the humidity as detected by the environment detection unit when controlling the inter-peak voltage of the AC voltage being applied by the power source to the charging member on the basis of the electric current gauged by the ammeter.

The value of the inter-peak voltage of the AC voltage that needs to be gauged in order to realize uniform electric discharges can vary as a function of fluctuations of the surroundings of the photosensitive body. Therefore, it is possible to realize an electrically more uniform charging with this arrangement.

In addition, in an image forming apparatus of the present invention, the power source is preferably a constant current source from the viewpoint of realizing an electrically more uniform charging.

In an image forming apparatus of the present invention, the charging member may also be a contact charging member adapted to electrically charge the photosensitive body in a state where it contacts the photosensitive body.

Preferably, an image forming apparatus of the present invention further has a transfer member arranged at a transfer position located downstream relative to the charging member as viewed in the moving direction of the photosensitive body and adapted to contact the photosensitive body directly or by way of a predetermined intermediary transfer body in order to transfer the toner image formed on the photosensitive body onto a predetermined object of transfer and the transfer member may operate as the contact member.

The transfer member to which a transfer bias voltage is applied is often provided with an ammeter to be used for controlling the transfer bias voltage. Therefore, when the transfer member operates also as the contact member, the ammeter can be used for the purpose of gauging the electric current that is caused to flow due to the electric charge on the photosensitive body to suppress the cost.

Preferably, in an image forming apparatus of the present invention, the transfer member is a transfer roll.

More preferably, the transfer roll is provided with a blade adapted to contact the peripheral surface of the transfer roll.

When the surface of the transfer roll is stained, its electric resistance changes so that the reading of the ammeter can involve an error that corresponds to the change in the electric resistance. When the transfer roll is provided with a blade, the surface of the transfer roll is cleaned to make the reading of the ammeter more accurate and realize an electrically more uniform charging.

Further, in an image forming apparatus of the present invention, the transfer roll may be pressed against the surface of the photosensitive body with a constant load.

The reading of the ammeter can involve an error when the nipping length at the transfer position changes. However, this arrangement makes the reading of the ammeter more accurate and realizes an electrically more uniform charging.

Here, an image forming apparatus of the present invention may further have a transfer member arranged at a transfer position located downstream relative to the charging member as viewed in the moving direction of the photosensitive body and adapted to contact the photosensitive body directly or by way of a predetermined intermediary transfer body in order to transfer the toner image formed on the photosensitive body onto a predetermined object of transfer;

a cleaning blade arranged downstream relative to the transfer position and adapted to contact the photosensitive body in order to remove the toner remaining on the photosensitive body;

the cleaning blade operating as the contact member.

Alternatively, an image forming apparatus of the present invention may further have a transfer member arranged at a transfer position located downstream relative to the charging member as viewed in the moving direction of the photosensitive body and adapted to contact the photosensitive body directly or by way of a predetermined intermediary transfer body in order to transfer the toner image formed on the photosensitive body onto a predetermined object of transfer; and a toner charging control member arranged downstream relative to the transfer position and adapted to contact the photosensitive body in order to electrically charge the toner remaining on the photosensitive body;

the toner charging control member operating as the contact member.

Still alternatively, an image forming apparatus of the present invention may further have a transfer member arranged at a transfer position located downstream relative to the charging member as viewed in the moving direction of the photosensitive body and adapted to contact the photosensitive body directly or by way of a predetermined intermediary transfer body in order to transfer the toner image formed on the photosensitive body onto a predetermined object of transfer;

a rotary brush arranged downstream relative to the transfer position and adapted to contact the photosensitive body; and a voltage applying section adapted to apply a collection voltage for collecting the toner remaining on the photosensitive body to the rotary brush and also apply an ejection voltage for causing the rotary brush to eject the collected toner onto the photosensitive body at a predetermined timing.

The rotary brush may operate as the contact member.

In an image forming apparatus of the type under consideration, the cleaning blade that is adapted to contact the photosensitive body is omitted in many cases. Such an image forming apparatus can be accompanied by a problem that discharge products adhere to the surface of the photosensitive body if compared with an image forming apparatus having a cleaning blade. However, the adherence of discharge products to the surface of the photosensitive body of an image forming apparatus from which the cleaning blade is omitted is reduced because excessive electric discharges are suppressed by the power source control section.

An image forming apparatus of the present invention may have plural photosensitive bodies that form respective toner images in different colors to produce a full color image.

Furthermore, in an image forming apparatus of the present invention, it is preferable that the power source is adapted to supply electric power showing a voltage waveform obtained by superimposing an AC voltage on a DC voltage to the charging member;

the photosensitive body has a characteristic that the charged voltage rises substantially linearly to a predetermined inter-peak threshold voltage as the inter-peak voltage of the AC voltage increases and remains substantially at a constant level when the inter-peak voltage of the AC voltage exceeds the predetermined inter-peak threshold voltage; and the power source control section detects the inter-peak threshold voltage on the basis of the electric current gauged by the ammeter and controls the AC voltage being superimposed on the DC voltage of the power source on the basis of the inter-peak threshold voltage.

In addition, an apparatus of the present invention may have the ammeter adapted to gauge the electric current caused to flow by the electric charge of the photosensitive body that is electrically charged by the charging member between an image forming process and the next image forming process out of a plurality of consecutive image forming processes.

As the electric current gauging unit is adapted to gauge the electric current during the time interval of two consecutive printing operations (jobs) and hence between two consecutively processed pages carrying respective images that are different from each other, it is no longer necessary to gauge the electric current at a job start and a job end. Thus, the next job can be started immediately.

BRIEF DESCRIPTION OF THE DRAWINGS

Preferred embodiments of the present invention will be described in detail based on the following figures, wherein.

DESCRIPTION OF THE PREFERRED EMBODIMENT

Now, preferred embodiments of the present invention will be described in detail.

Figure 1:
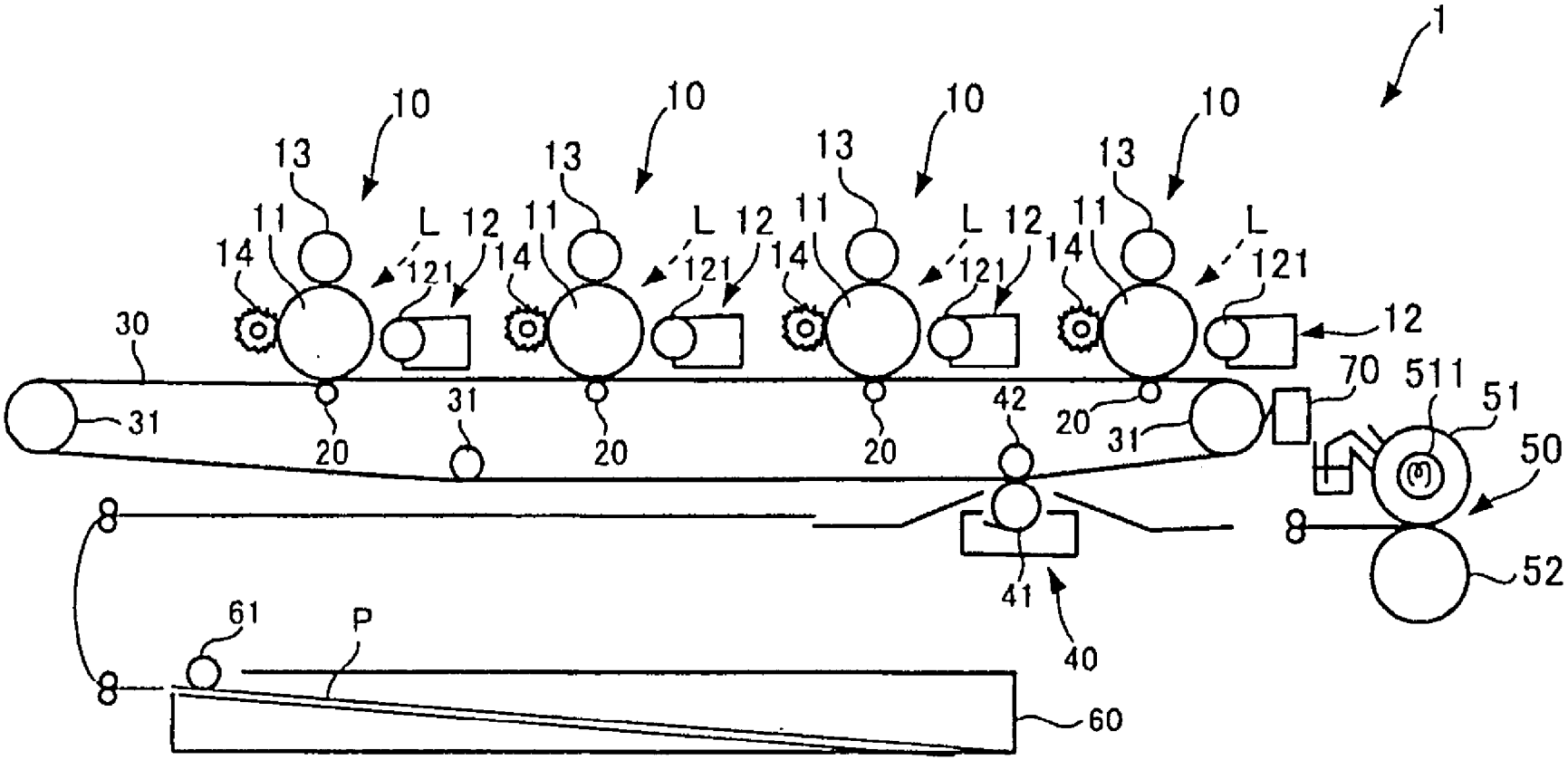
FIG. 1 is a schematic illustration of the configuration of the first embodiment of image forming apparatus according to the invention.

FIG. 1 is a schematic illustration of the configuration of the first embodiment of image forming apparatus according to the invention.

An image forming apparatus 1 of this embodiment is a full color tandem type image forming apparatus having four toner image forming units that respectively use yellow, magenta, cyan and black toners to form toner images of the respective colors in synchronism with the movement of an intermediary transfer belt. The toner images are laid one on the other on the intermediary transfer belt, which is an intermediary medium (primary transfer) and the image formed on the intermediary transfer belt by sequentially laying the toner images is transferred onto a sheet of paper, which is a recording medium (secondary transfer), and fixed.

The image forming apparatus 1 of FIG. 1 has four toner image forming units 10, four primary transfer rolls 20, an intermediary semiconductor transfer belt 30 supported by three support rolls 31 and driven to circulate counterclockwise in FIG. 1, a collective transfer device 40 for secondary transfer and a fixing device 50 for fixing the unfixed toner image onto a sheet of paper.

The four toner image forming units 10 are arranged along the route of circulation of the intermediary transfer belt 30 and each of the toner image forming units 10 is provided with a photosensitive drum 11 that is adapted to revolve clockwise. The intermediary transfer belt 30 is held in contact with the surfaces of the photosensitive drums 11. The primary transfer rolls 20 are arranged at positions facing the respective photosensitive drums 11 with the intermediary transfer belt 30 interposed between the primary transfer rolls 20 and the corresponding photosensitive drums 11. The primary transfer position of each of the photosensitive drums 11 is defined as the part thereof that is held in contact with the intermediary transfer belt 30.

Each of the toner image forming units 10 of the embodiment has a contact type charging device 13 that is also an embodiment of charging device according to the invention as well as a developing device 12 and a cleaning brush 14. The developing device 12 is arranged at a position located close to the corresponding photosensitive drum 11 and upstream relative to the primary transfer position. The contact type charging device 13 is arranged upstream relative to the developing device 12. The cleaning brush 14 is arranged at a position located close to the corresponding photosensitive drum 11 and downstream relative to the primary transfer position.

The surface of the photosensitive drums 11 is electrically uniformly charged by the contact type charging device 13. A laser beam L is irradiated onto the surface of the photosensitive drum 11 that has been electrically uniformly charged by the contact type charging device 13 to form an electrostatic latent image on the surface of the photosensitive drum 11. The developing device 12 is adapted to be used with a two-component developing system and contains a magnetic carrier and non-magnetic toner charged negatively relative to a predetermined reference bias voltage. Each of the developing devices 12 shown in FIG. 1 is provided with a mag roll 121. A developing agent layer is formed on the peripheral surface of the mag roll 121. The magnetic carrier is made to show a brush-like profile (so-called a magnetic brush) on the developing agent layer and toner is caused to adhere to it. The non-magnetic toner moves from the developing agent layer to the surface of the photosensitive drum 11 that carries an electrostatic latent image thereon. The electrostatic latent image is developed to become a toner image as the non-magnetic toner moves to the surface of the photosensitive drum 11.

A transfer bias voltage showing a polarity opposite to that of the toner (in this case positive relative to the predetermined reference bias voltage) is applied to the primary transfer roll 20 so that the toner image formed on the surface of the photosensitive drum 11 is moved from the surface of the photosensitive drum to the surface of the intermediary transfer belt 30. The toner images formed on the respective toner image forming units 10 are laid one on the other on the intermediary transfer belt 30 to produce a single full color toner image.

The collective transfer device 40 is provided with a secondary transfer roll 41 held in contact with the surface of the toner image carrying side of the intermediary transfer belt 30 so as to press the latter and a backup roll 42 arranged at the rear surface side of the intermediary transfer belt 30. The intermediary transfer belt 30 is pinched between these rolls 41, 42. The area located between the rolls 41, 42 is defined as the secondary transfer position.

The image forming apparatus 1 of FIG. 1 further has a sheet tray 60, and a sheet of paper P is fed from the sheet tray 60 to the secondary transfer position at a predetermined timing by means of a feed roll 61. At the secondary transfer position, the toner image on the intermediary transfer belt 30 that is formed by laying the toner images of the photosensitive drums 11 one on the other is transferred onto the sheet of paper P that is also fed to that position. The fixing device 50 has a fixing roll 51 provided with a heating mechanism 511 and a pressure roll 52 disposed vis-à-vis the fixing roll 51. The sheet of paper P that has passed through the secondary transfer position is moved to between the fixing roll 51 and the pressure roll 52 that are disposed vis-à-vis. The toners of the toner image on the sheet of paper P are fused and fixed by the heating mechanism 511 of the fixing roll 51.

A belt cleaner 70 is arranged downstream relative to the collective transfer device 40 for the purpose of removing the residual toner on the intermediary transfer belt 30. A so-called cleanerless system is adopted in this image forming apparatus 1 and hence it does not have cleaning blades that are respectively held in contact with the photosensitive drums 11. More specifically, a collection bias voltage (in this case a bias voltage showing a positive polarity relative to the predetermined reference bias voltage) for collecting the toner remaining on each of the photosensitive drums 11 and an ejection bias voltage (in this case a bias voltage showing a negative polarity relative to the predetermined reference bias voltage) for ejecting the collected toner onto the photosensitive drum 11 are applied to the corresponding one of the cleaning brushes 14 shown in FIG. 1. Thus, each of the cleaning brushes 14 collects and holds the residual toner as the collection bias voltage is applied at the time of an image forming operation and subsequently ejects the residual toner onto the corresponding photosensitive drum 11 when ejection bias voltage is applied in the time interval between the image forming operation and the next image forming operation. The toner ejected onto the photosensitive drum 11 is transferred onto the intermediary transfer belt 30 at the corresponding primary transfer position and ultimately removed from the intermediary transfer belt 30 by belt cleaner 70.

Figure 2:
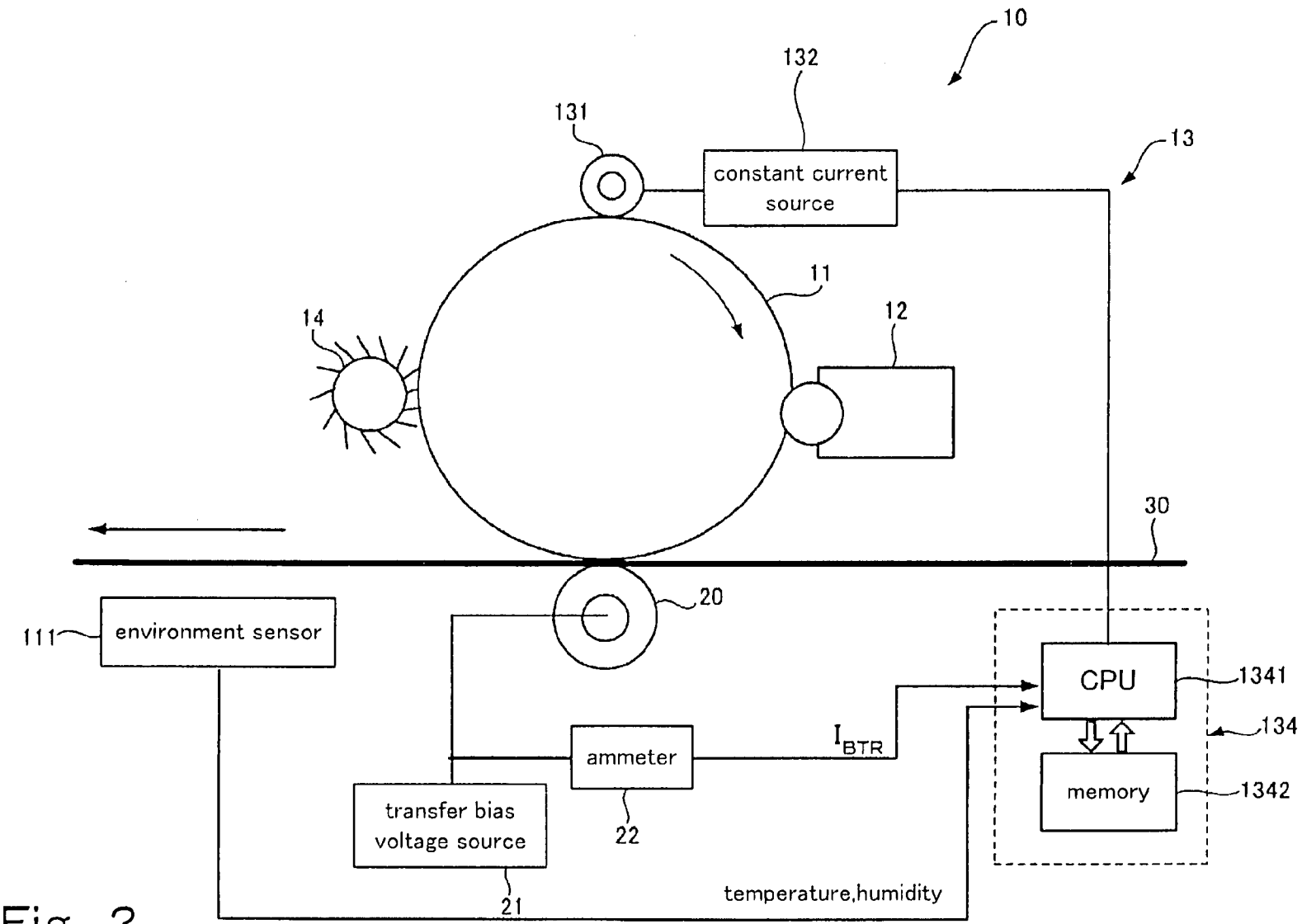
FIG. 2 is a schematic illustration of the configuration of a contact type charging device with which each of the four toner image forming units of FIG. 1 is provided.

FIG. 2 is a schematic illustration of the configuration of a contact type charging device with which each of the four toner image forming units of FIG. 1 is provided.

FIG. 2 shows a photosensitive drum 11, a developing device 12, a contact type charging device 13, a cleaning brush 14, a primary transfer roll 20 and part of a semiconductor intermediary transfer belt 30. The image forming apparatus 1 of FIG. 1 additionally has a transfer bias voltage source 21 for supplying a transfer bias voltage to each of the primary transfer rolls 20, ammeters 22 to be used for controlling the transfer bias voltages supplied to the respective primary transfer rolls 20 and an environment sensor 111 for detecting the temperature and the humidity of the surroundings of the photosensitive drums 11, which are also shown in FIG. 2.

The contact type charging device 13 shown in FIG. 2 has a charging roll 131 held in contact with the photosensitive drum 11 so as to be driven to revolve by the drum 11. The surface of the charging roll 131 is semiconductor and adapted to electrically charge the photosensitive drum 11 by generating electric discharges in micro-gaps near the area that contacts the photosensitive drum 11. The contact type charging device 13 additionally has a constant current source 132 that supplies the charging roll 131 with electric power showing a voltage waveform obtained by superimposing an AC voltage on a DC voltage and a constant current source control section 134. Thus, electric power showing a voltage waveform obtained by superimposing an AC voltage on a DC voltage is supplied from the constant current source 132 to the charging roll 131.

The constant current source 132 shown in FIG. 2 can serve to change the frequency of the AC component according to the change in processing speed such as rotational speed of the photosensitive drum 111.

An electric current flows to the primary transfer roll 20 by way of the intermediary transfer belt 30 due to the electric charge on the photosensitive drum 11 that is electrically charged by the charging roll 131 (to be referred to as transfer current hereinafter). The transfer current is a DC current that is gauged by the ammeter 22, which serves to control the transfer bias voltage.

When electric power showing a waveform obtained by superimposing an AC voltage on a DC voltage is supplied to the charging roll 131, the realized electric charging is more uniform than the electric charging that is observed when electric power showing a waveform of a DC voltage to which no AC voltage added is supplied to the charging roll 131. Then, however, the number of times of collisions of ions with the surface of the photosensitive body increases to raise the amount of electric discharge products adhering to the surface of the photosensitive body so that deletions such as white spots can easily appear. Additionally, the photosensitive body can be quickly degraded. In view of these problems, the current value or the inter-peak voltage Vpp of the AC component of electric power being supplied to the charging roll is modified and the effect of such modification was verified for the purpose of minimizing the problems in a manner as described in detail below.

Figure 3:
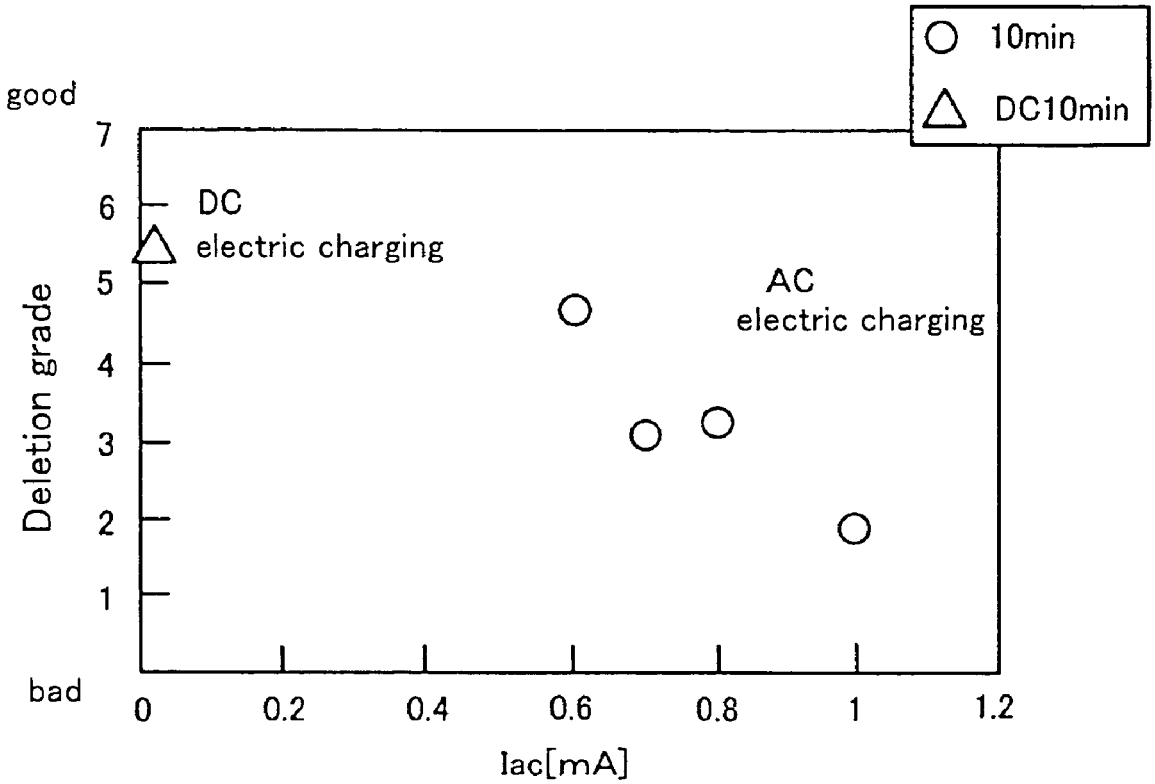
FIG. 3 is a graph illustrating the relationship between the quality of the image formed by supplying electric power to the charging roll, modifying the electric current of the AC component of electric power supplied to the charging roll, and the electric current of the AC component.

FIG. 3 is a graph illustrating the relationship between the quality of the image formed by supplying electric power to the charging roll, modifying the electric current of the AC component of electric power supplied to the charging roll, and the electric current value of the AC component.

In the graph of FIG. 3, the horizontal axis represents the electric current value $I_{ac}$ (mA) of the AC component of electric power supplied to the charging roll, whereas the vertical axis of the graph represents the quality of the image. The quality of image is visually rated in seven grades (Grade 1 through 7) by seeing the formed image on the basis of the deletions appearing on the image. Grade 1 is given to an image of the lowest quality where deletions are very remarkable, whereas Grade 7 is given to an image of the highest quality where practically no deletion is visible. Each of the white circles in the graph of FIG. 3 indicates a so-called AC charging where an image is formed by supplying electric power showing a voltage waveform obtained by superimposing an AC voltage on a predetermined DC voltage for ten minutes. It will be seen from the graph of FIG. 3 that generation of deletions is suppressed more when the current value of the AC component is small. The white triangle in the graph of FIG. 3 indicates a so-called DC charging where electric power showing a waveform of a DC voltage to which no AC voltage added is supplied to the charging roll 131 for ten minutes to see deletions for the purpose of comparison.

The electric current value $I_{ac}$ and the inter-peak voltage Vpp of the AC component of electric power being supplied to the charging roll are linearly proportional relationship. Therefore, appearance of deletions can be suppressed by superimposing an AC voltage showing a low inter-peak voltage Vpp.

Figure 4:
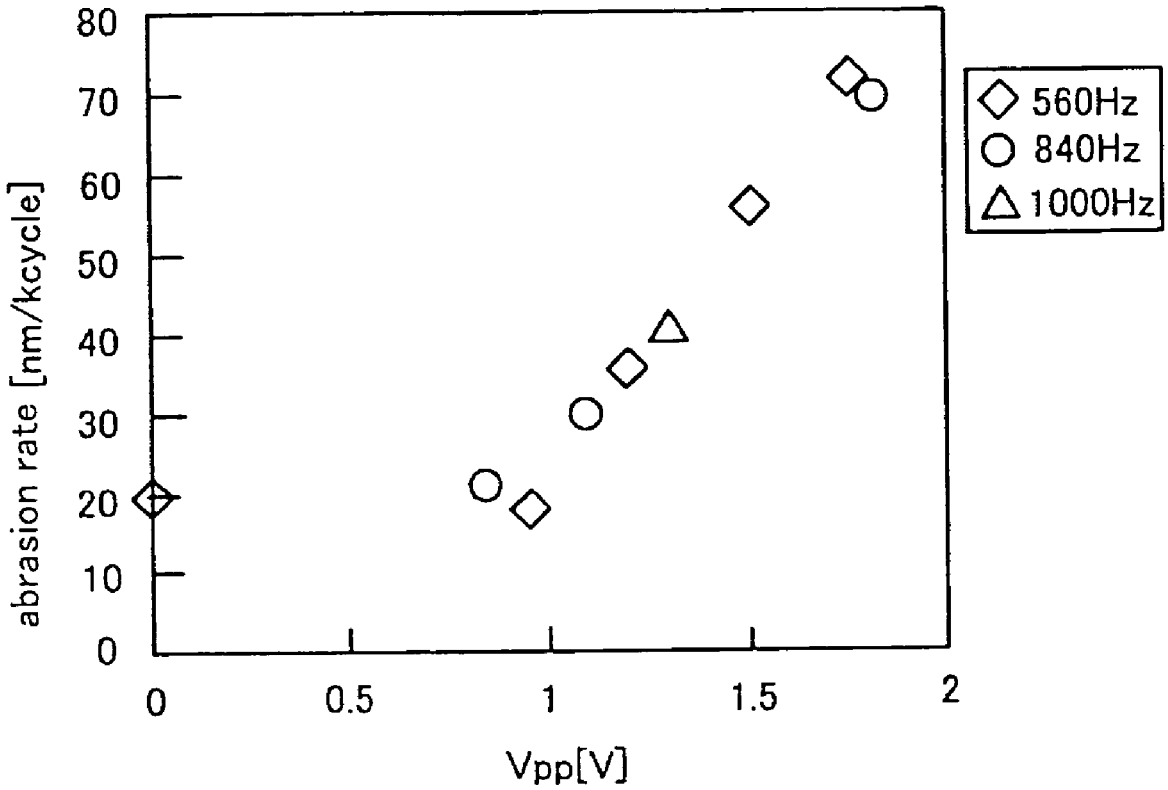
FIG. 4 is a graph illustrating the relationship between the inter-peak voltage Vpp of the AC component of electric power supplied to the charging roll and the rate at which the photosensitive drum is abraded.

FIG. 4 is a graph illustrating the relationship between the inter-peak voltage Vpp of the AC component of electric power supplied to the charging roll and the rate at which the photosensitive drum is abraded.

In the graph of FIG. 4, the horizontal axis represents the inter-peak voltage Vpp (V) of the AC component of power supplied to the charging roll, whereas the vertical axis represents the abrasion rate (nm/kcycle) obtained by observing the abrasion (nm) of the photosensitive drum after continuously charging it by means of the charging roll while driving it to make 1,000 revolutions. In the graph of FIG. 4, each of the white square indicates the data obtained after continuously supplying electric power showing a waveform obtained by superimposing an AC voltage of 560 Hz on a predetermined DC voltage to the charging roll 131, each of the white circle indicates the data obtained after continuously supplying electric power showing a waveform obtained by superimposing an AC voltage of 840 Hz on a predetermined DC voltage to the charging roll 131, and each of the white triangles indicates the data obtained after continuously supplying electric power showing a waveform obtained by superimposing an AC voltage of 100 Hz on a predetermined DC voltage to the charging roll 131. It will be seen from the graph in FIG. 4, the abrasion of the photosensitive drum 11 is determined as a function of the inter-peak voltage Vpp regardless of the frequency of the AC component. The abrasion of the photosensitive drum 11 is small when the inter-peak voltage Vpp is low.

From the above results, it is desirable that the inter-peak voltage Vpp of the AC voltage is held as low as possible within the limit of allowing the photosensitive drum 11 to be electrically uniformly charged when supplying electric power to the charging roll 131.

Before describing the constant current source control section 134 of FIG. 2 in greater detail, the characteristic of the photosensitive drum 11 will be described in detail by referring to FIG. 5.

Figure 5:
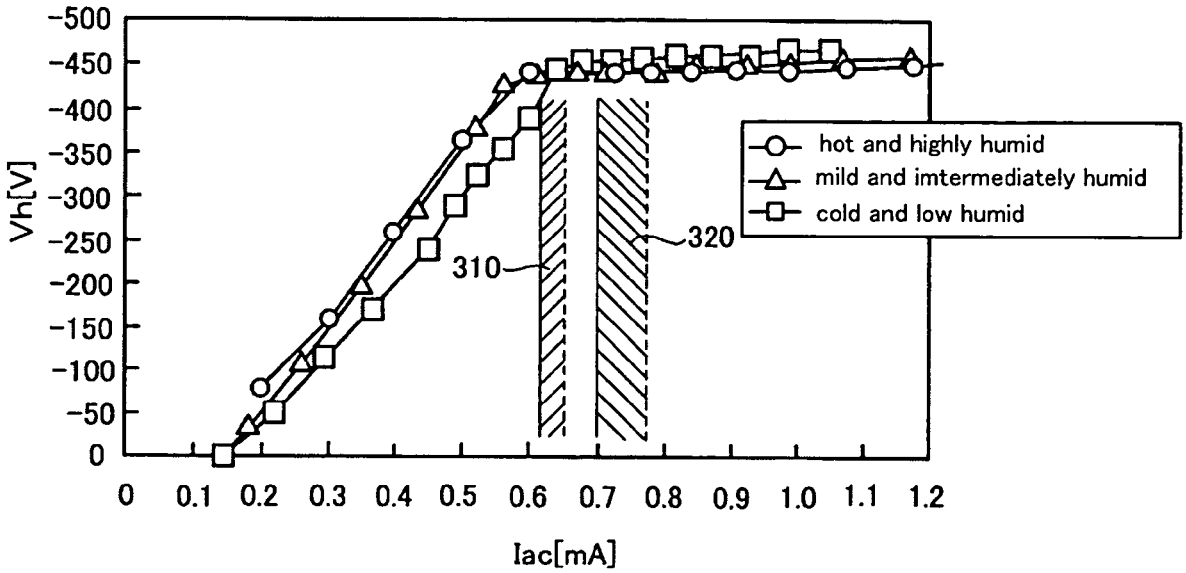
FIG. 5 is a graph illustrating the electrically charging characteristic of the photosensitive drum of FIG. 2.

FIG. 5 is a graph illustrating the electrically charging characteristic of the photosensitive drum of FIG. 2.

In the graph of FIG. 5, the horizontal axis represents the electric current value $I_{ac}$ (mA) of the AC component of electric power supplied to the charging roll 131, whereas the vertical axis of the graph represents the electric potential Vh (V) of the surface of the photosensitive drum 11. The solid line plotting the white circles in FIG. 5 is obtained when the photosensitive drum 11 is placed in a hot (28° C.) and highly humid (85%) environment, whereas the solid line plotting the white squares is obtained when the photosensitive drum 11 is placed in a cold (10° C.) and low humid (15%) environment. The solid line plotting the white triangles is obtained when the photosensitive drum 11 is placed in a mild (22° C.) and intermediately humid (55%) environment.

Now, referring to FIG. 2, a DC voltage of −450V is applied to the photosensitive drum 11 by the contact type charging device 13 in order to make it electrically charged to −450V. With each of the graphs of FIG. 5, the electric potential Vh of the surface of the photosensitive drum 11 rises substantially linearly as the electric current value $I_{ac}$ (mA) of the AC component is raised until the surface electric potential Vh gets to −450V. However, once the surface electric potential Vh gets to −450V, it does not rise anymore even if the electric current value $I_{ac}$ of the AC component is raised. In other words, the surface electric potential Vh remains at a substantially same level. Therefore, the photosensitive drum 11 of FIG. 2 cannot be electrically charged to decrease below −450V due to the electrically charging characteristic of the photosensitive drum 11. Differently stated, when the electric current value $I_{ac}$ of the AC component is raised gradually, electric discharges take place unevenly until the surface electric potential Vh of the photosensitive drum 11 gets to −450V but, once the surface electric potential Vh gets to −450V, simply excessive electric discharges take place there. The lowest inter-peak voltage Vpp of the AC voltage that can bring the surface electric potential Vh of the photosensitive drum 11 to the saturation potential level of −450V is referred to as inter-peak threshold voltage Vth hereinafter.

The electric current value $I_{ac}$ of the AC component is about 0.6 mA in a hot (28° C.) and highly humid (85%) environment and about 0.7 mA in a cold (10° C.) and low humid (15%) environment. A hatched area 310 of rising lines in FIG. 5 shows the margin in a hot and highly humid environment, whereas a hatched area 320 of falling lines in FIG. 5 shows the margin in a cold and low humid environment. Abnormal discharges can easily occur in a cold (10° C.) and low humid (15%) environment and therefore uniform electric discharges cannot be guaranteed without a large margin for the inter-peak threshold voltage (see the hatched area 320 of falling lines in FIG. 5). The margin for the inter-peak threshold voltage needs to be increased when changes in the electric resistance due to the dirt on the surface of the charging roll 131 and those in the state of the surface of the photosensitive drum 11 that can take place after a long use are taken into consideration. Therefore, 1.0 mA is selected for the electric current value $I_{ac}$ of the AC component in some conventional image forming apparatus having photosensitive drums with an electrically charging characteristic as shown in FIG. 5.

Figure 6:
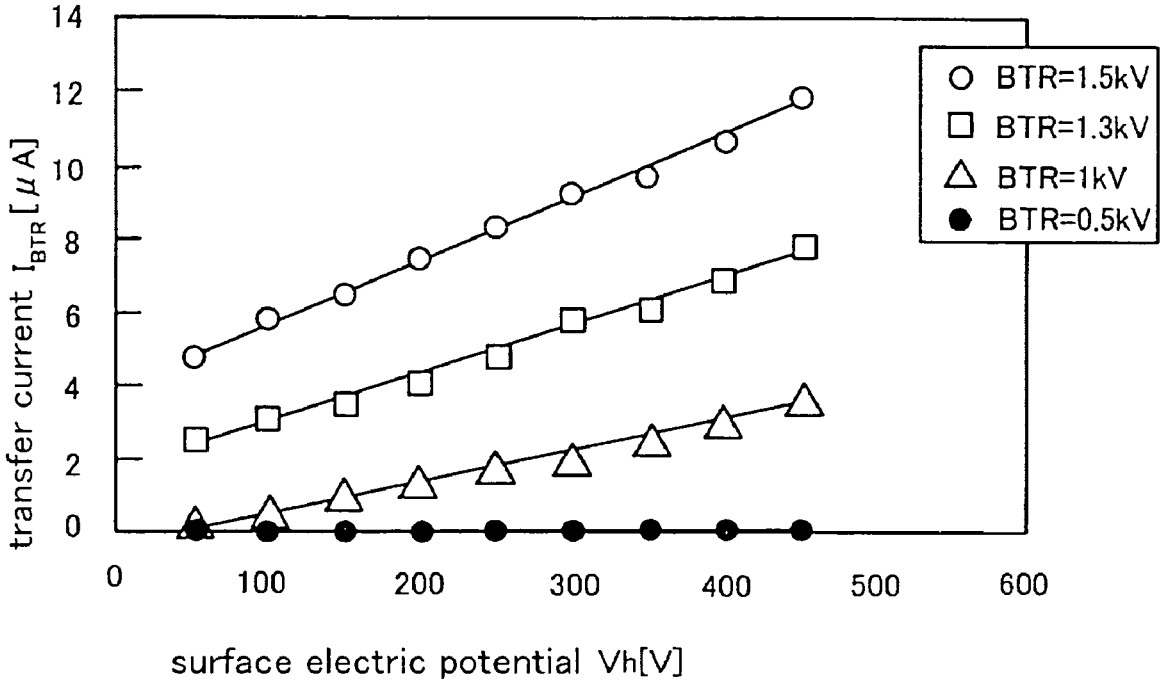
FIG. 6 is a graph illustrating the relationship between the electric potential of the surface of the photosensitive drum and the transfer current.

FIG. 6 is a graph illustrating the relationship between the electric potential of the surface of the photosensitive drum and the transfer current.

In the graph of FIG. 6, the horizontal axis represents the surface electric potential Vh (V) of the photosensitive drum and the vertical axis represents the electric current value $I_{BTR}$ (μA) of the transfer current as gauged by the ammeter 22. In FIG. 6, the solid line plotting the white circles is obtained when 1.5 kV is selected for the transfer bias voltage applied to the primary transfer roll 20 and the solid line plotting the white squares is obtained when 1.3 kV is selected for the transfer bias voltage, whereas the solid line plotting the white triangles is obtained when 1.0 kV is selected for the transfer bias voltage and the solid line plotting the black circles is obtained when 0.5 kV is selected for the transfer bias voltage. It is clear from the graph of FIG. 6 that the surface electric potential Vh of the photosensitive drum and the electric current value $I_{BTR}$ of the transfer current show a linearly proportional relationship. In view of this fact, it is not necessary to gauge the surface electric potential Vh of the photosensitive drum by means of an expensive instrument and the surface electric potential Vh of the photosensitive drum can be reliably estimated by gauging the electric current value $I_{BTR}$ of the transfer current that flows to the primary transfer roll 20. As shown in FIG. 6, the electric current value $I_{BTR}$ of the transfer current decreases as the transfer bias voltage falls and it is practically impossible to detect any changes in the electric current value by means of the ammeter 22 shown in FIG. 3 when the transfer bias voltage is 0.5 kV. The transfer bias voltage source 21 in FIG. 2 that supplies a transfer bias voltage to the primary transfer roll 20 is adapted to supply a sufficiently large transfer bias voltage with which the primary transfer operation is carried out reliably and changes in the electric current value of the transfer current can be clearly detected by the ammeter 22.

Now, the relationship between electric current value $I_{ac}$ of the AC component of electric power supplied to the charging roll 131 and the electric current value $I_{BTR}$ of the transfer current that is gauged by the ammeter 22 will be described by referring to FIGS. 7 through 9.

Figure 7:
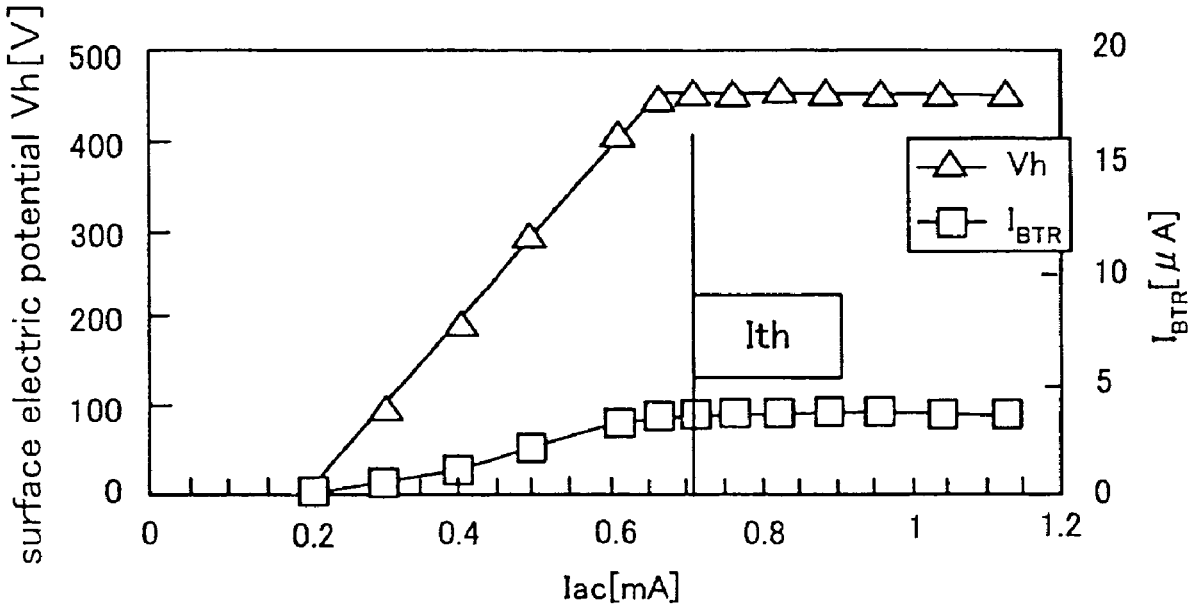
FIG. 7 is a graph illustrating the relationship between the electric potential of the surface of the photosensitive drum and the transfer current when a transfer bias voltage of 1.0 kV is applied to the primary transfer roll.
Figure 8:
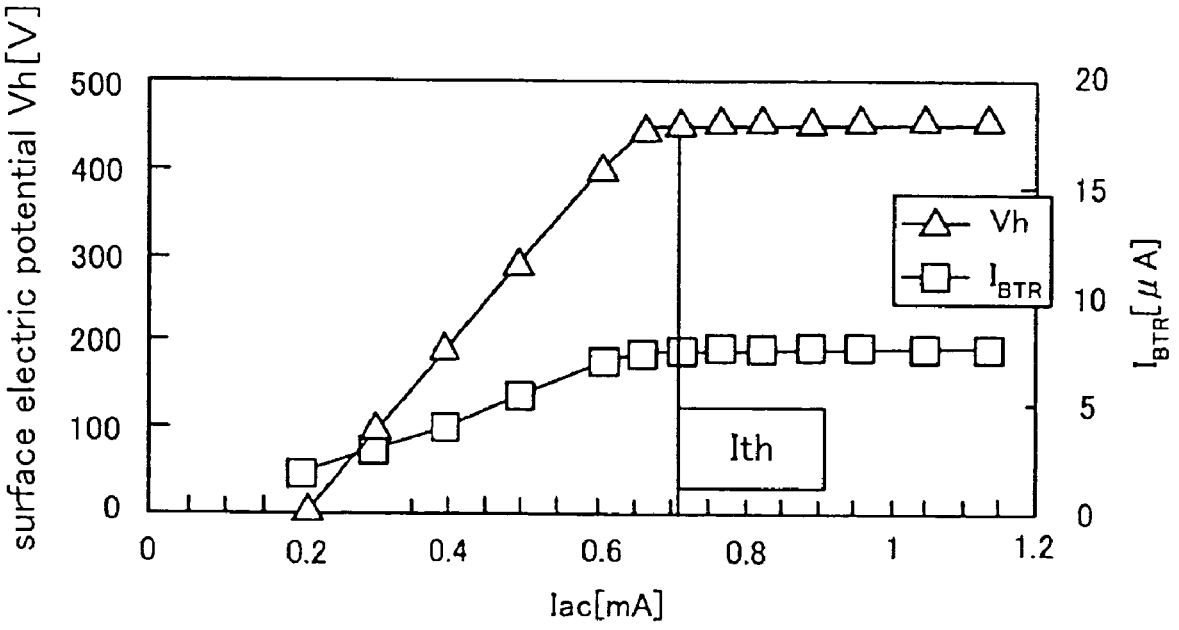
FIG. 8 is graph illustrating the relationship between the electric potential of the surface of the photosensitive drum and the transfer current when a transfer bias voltage of 1.3 kV is applied to the primary transfer roll.
Figure 9:
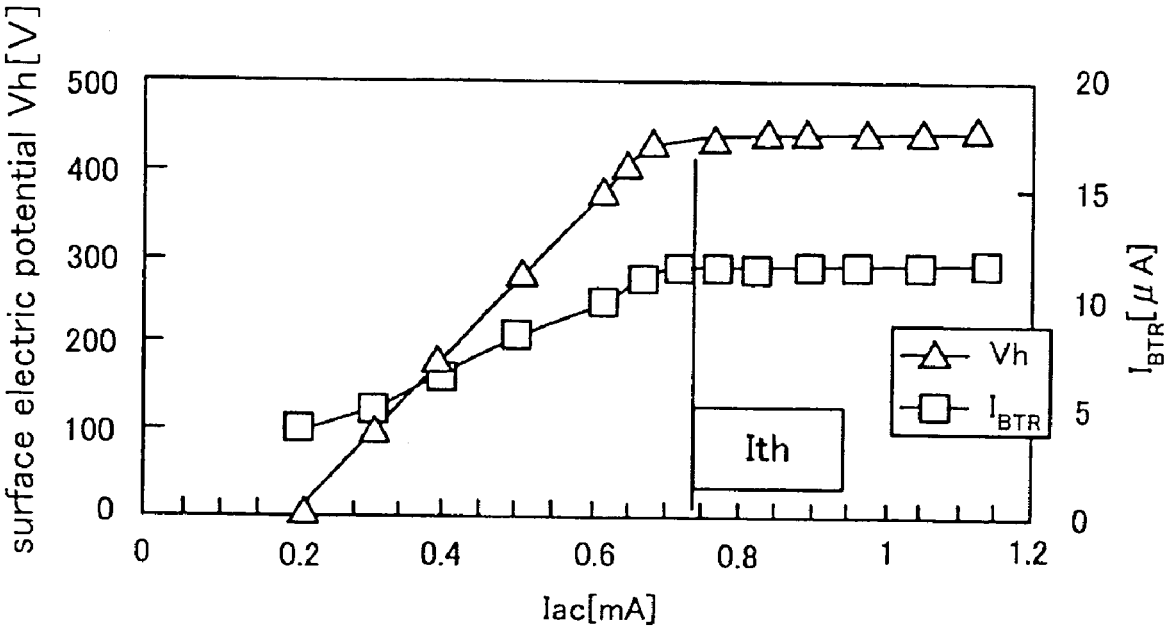
FIG. 9 is graph illustrating the relationship between the electric potential of the surface of the photosensitive drum and the transfer current when a transfer bias voltage of 1.5 kV is applied to the primary transfer roll.

FIG. 7 is a graph illustrating the relationship when a transfer bias voltage of 1.0 kV is applied to the primary transfer roll and FIG. 8 is a graph illustrating the relationship when a transfer bias voltage of 1.3 kV is applied to the primary transfer roll, while FIG. 9 is a graph illustrating the relationship when a transfer bias voltage of 1.5 kV is applied to the primary transfer roll.

In each of the graphs of FIGS. 7 through 9, the horizontal axis represents the electric current value $I_{ac}$ (mA) of the AC component of electric power supplied to the charging roll 131 and the vertical axis represents the surface electric potential Vh (V) of the photosensitive drum 11 and the electric current value $I_{BTR}$ (μA) of the transfer current as gauged by the ammeter 22. In each of the graphs, the solid line plotting the white triangles shows the change in the surface electric potential Vh of the photosensitive drum 11 and the solid line plotting the white squares shows the change in the electric current value $I_{BTR}$ of the transfer current. What worthy of attention in the graphs is that both the change in the surface electric potential Vh of the photosensitive drum 11 and the change in the electric current value $I_{BTR}$ of the transfer current show a similar tendency, although the gradients of the two lines differ from each other. In other words, in each of the graphs of FIGS. 7 through 9, the electric current value $I_{BTR}$ of the transfer current substantially linearly rises as a function of the rise of the electric current value $I_{ac}$ of the AC component until the surface electric potential Vh of the photosensitive drum gets to the saturation potential level but, once the surface electric potential Vh of the photosensitive drum reaches the saturation potential level, the electric current value $I_{BTR}$ of the transfer current remains substantially at the same level regardless of the rise of the electric current value $I_{ac}$ (mA)

of the AC component. Differently stated, the electric current value $I_{BTR}$ of the transfer current is saturated when the surface electric potential Vh of the photosensitive drum 11 is saturated.

The constant current source control section 134 shown in FIG. 2 is designed by taking the characteristic of the photosensitive drum 11 into consideration so that it controls the constant current source 132 on the basis of the electric current value $I_{BTR}$ of the transfer current. More specifically, the constant current source control section 134 controls the electric current of the AC component supplied to the charging roll 131 by the constant current source 132. Here, a case where inter-peak voltage Vpp of the AC voltage is controlled is used for showing an example of controlling the electric current of an AC component. Alternatively, the electric current of an AC component can be controlled by the other methods including the followings:

1. utilize the change of impedance (1/ωC) between the surfaces of the charging roll 131 and the photosensitive drum 11 caused by the change of frequency of the AC component; or
2. control the form of the voltage waveform of the AC component.

The constant current source control section 134 shown in FIG. 2 is provided with a CPU 1341 and a memory 1342 and the electric current value IBTR of the transfer current gauged by the ammeter 22 and the temperature and the humidity of the surroundings of the photosensitive drum 11 detected by the environment sensor 111 are transmitted to the CPU 1341.

Figure 10:
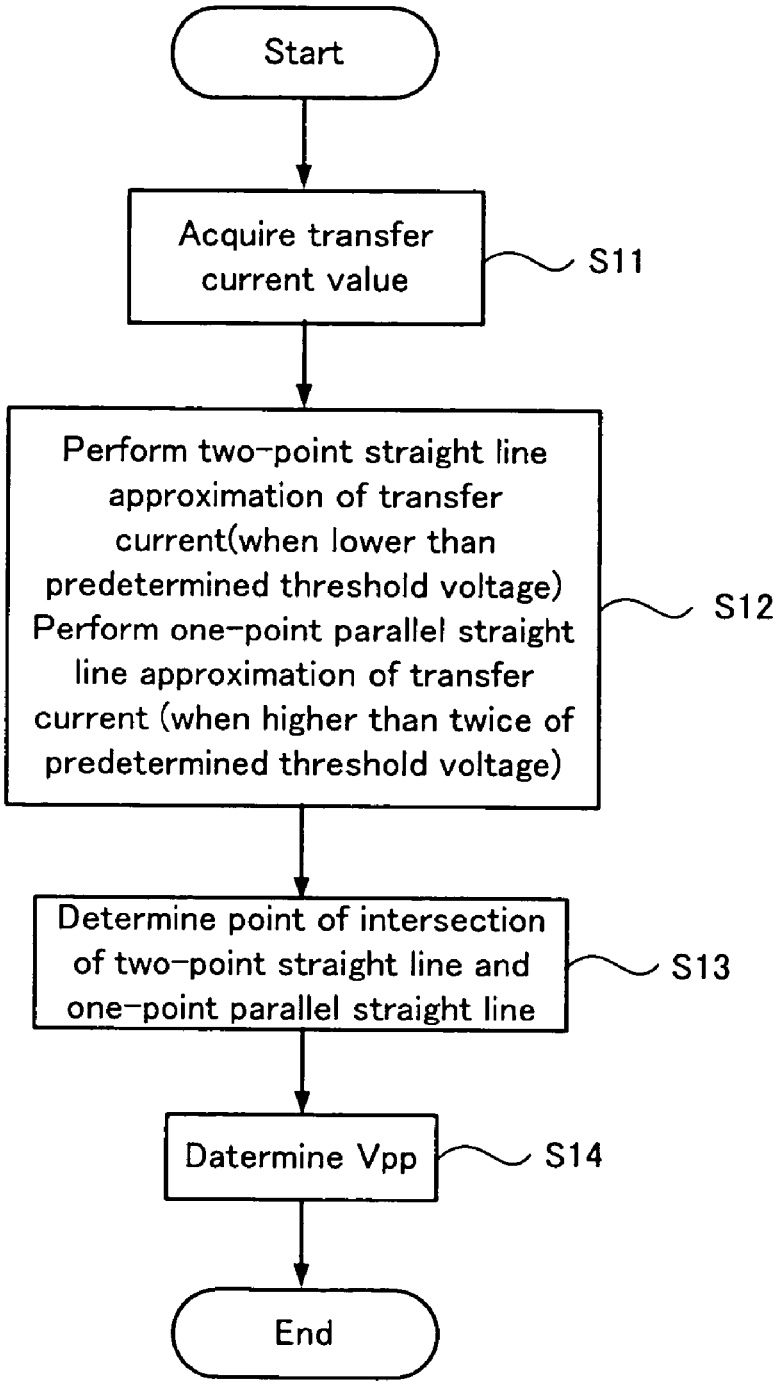
FIG. 10 is a flow chart of the arithmetic operation of determining the inter-peak voltage to be performed by the CPU of the power source control section.

FIG. 10 is a flow chart of the arithmetic operation of determining the inter-peak voltage to be performed by the CPU of the power source control section.

The arithmetic operation of determining the inter-peak voltage as shown in FIG. 10 is executed before starting an image forming operation. More specifically, the operation starts when the main power supply of the image forming apparatus 1 is turned on. In view of the fact that the main power supply of the image forming apparatus 1 is turned on mostly in the morning and the image forming apparatus 1 has not been operating for a considerable time period, it is probably held in a low temperature environment and the photosensitive drums 11 are not affected by heat in the apparatus. As pointed out above, a large value needs to be selected for the electric current $I_{ac}$ of the AC component in order to bring the surface electric potential Vh of each of the photosensitive drum 11 to the saturation potential level and therefore a large value also has to be selected for the inter-peak voltage Vpp. Thus, the arithmetic operation of determining the inter-peak voltage starts at a good timing if it starts in the morning. In the case of an image forming apparatus whose main power supply is held on constantly, it may be recommendable to select temperature, humidity and a number of image forming operations (a number of sheets of printing paper) in advance and execute the arithmetic operation before the execution of the next image forming operation if the temperature and the humidity detected by the environment sensor 111 shown in FIG. 2 fall below the selected respective values or if the number of sheets of printing paper exceeds the selected number.

In the arithmetic operation of determining the inter-peak voltage shown in FIG. 10, firstly the electric current value $I_{BTR}$ of the transfer current that is gauged by ammeter 22 shown in FIG. 2 is acquired and the acquired electric current value $I_{BTR}$ is stored in the memory 1342 (Step S11). In this case, electric power showing a voltage waveform obtained by sequentially superimposing on a predetermined DC voltage two AC voltages having respective inter-peak voltages that are different from each other and lower than a predetermined threshold voltage level is supplied to the charging roll 131 from the constant current source 132 arranged in the contact type charging device 13 shown in FIG. 2 and the electric current values $I_{BTR1}$, $I_{BTR2}$ of the transfer current as gauged by the ammeter 22 shown in FIG. 2 are acquired at this time. Additionally, electric power showing a voltage waveform obtained by superimposing on a predetermined DC voltage an AC voltage having an inter-peak voltage that is twice as high as the predetermined threshold voltage level is supplied to the charging roll 131 from the constant current source 132 and the electric current value $I_{BTR3}$ of the transfer current as gauged by the ammeter 22 is also acquired. In the instance of FIG. 10, an electric discharge triggering voltage that can trigger uniform electric discharges between the charging roll 131 and the photosensitive drum 11 on a stable basis as determined by means of the Paschen's law is stored in advance in the memory 1342 and the electric discharge triggering voltage is used as the predetermined threshold voltage. While the inter-peak voltage Vpp is computed after determining the inter-peak threshold voltage Vth in the arithmetic operation, the inter-peak threshold voltage Vth determined in the last session may alternatively be used as the predetermined threshold voltage. The CPU 1341 stores the electric current values $I_{BTR1}$ to $I_{BTR3}$ in the memory 1342.

Subsequently, a two-point straight line approximation and a one-point parallel straight line approximation take place (Step S12). Now, these approximations will be described by referring to FIG. 11.

Figure 11:
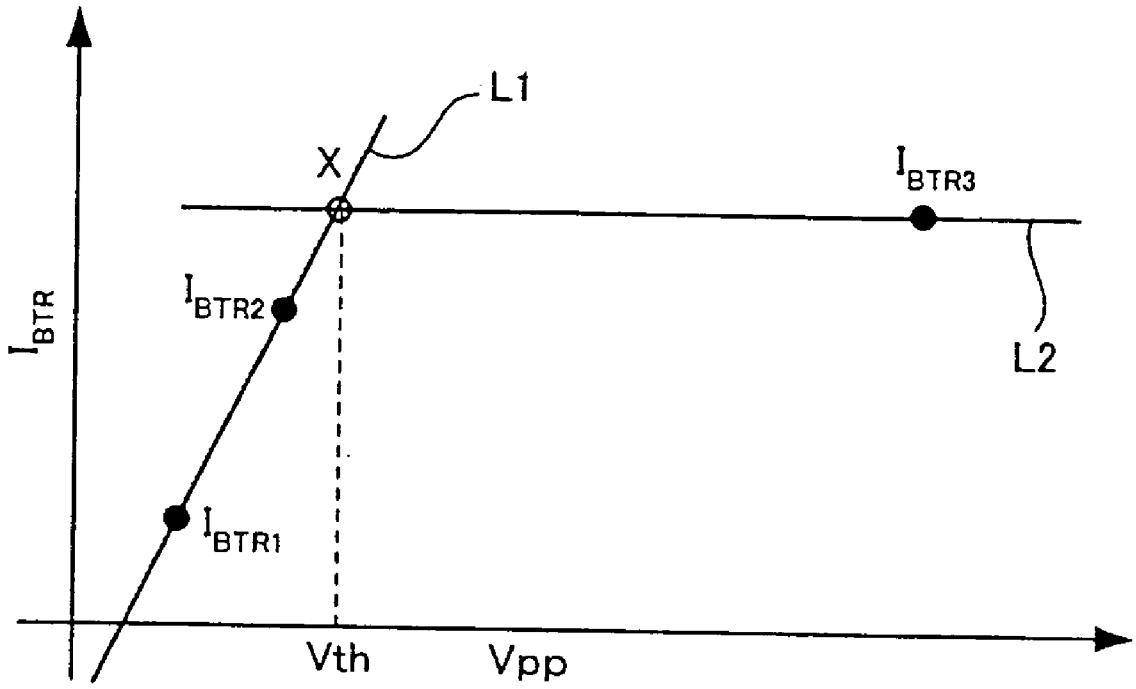
FIG. 11 is a graph illustrating a two-point straight line approximation and a one-point parallel straight line approximation.

FIG. 11 is a graph illustrating a two-point straight line approximation and a one-point parallel straight line approximation.

In the graph of FIG. 11, the horizontal axis represents the inter-peak voltage Vpp of the AC component of power supplied to the charging roll 131 and the vertical axis represents the electric current value $I_{BTR}$ of the transfer current. In the graph of FIG. 11, the electric current values $I_{BTR1}$, $I_{BTR2}$ of the transfer current gauged when electric power showing a voltage waveform obtained by sequentially superimposing on a predetermined DC voltage two AC voltages having respective inter-peak voltages that are different from each other and lower than a predetermined threshold voltage level is supplied are shown along with a two-point straight line L1 connecting the two electric current values $I_{BTR1}$, $I_{BTR2}$. Thus, the two-point straight line approximation is an operation of determining the two-point straight line L1. In the graph of FIG. 11, the electric current value $I_{BTR3}$ of the transfer current gauged when electric power showing a voltage waveform obtained by superimposing on a predetermined DC voltage an AC voltage having an inter-peak voltage that is more than the predetermined threshold voltage level is supplied to the charging roll 131 is also shown along with a one-point parallel straight line L2 running through the electric current value $I_{BTR3}$ in parallel with the horizontal axis. Thus, the one-point parallel straight line approximation is an operation of determining the one-point parallel straight line L2.

In Step S13 shown in FIG. 10, the point of intersection X of the two-point straight line L1 and the one-point parallel straight line L2 as shown in FIG. 11 is determined and the voltage at the point of intersection X is stored as inter-peak threshold voltage Vth in the memory 1342 in view of the above described characteristic of the photosensitive drum 11.

The effect of the use of such an inter-peak threshold voltage Vth was verified in a manner as described below by referring to FIGS. 12 and 13.

Figure 12:
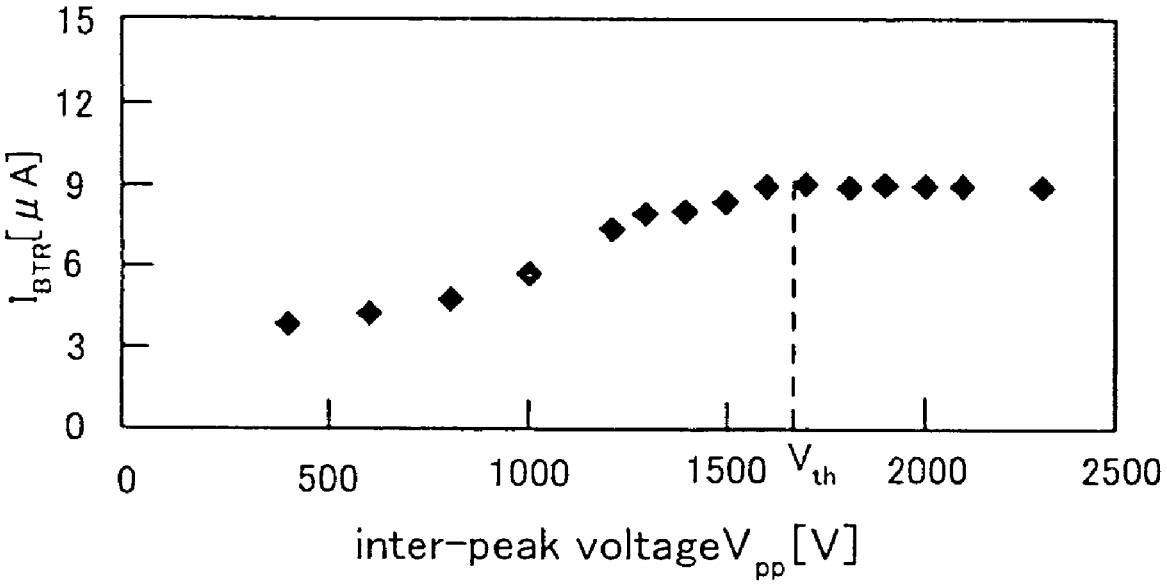
FIG. 12 is a graph illustrating the relationship between the inter-peak voltage Vpp of the AC component of electric power supplied to the charging roll and the transfer current $I_{BTR}$ as gauged by the ammeter in a cold and low humid environment.

FIG. 12 is a graph illustrating the relationship between the inter-peak voltage Vpp of the AC component of electric power supplied to the charging roll and the transfer current $I_{BTR}$ as gauged by the ammeter in a cold and low humid environment. FIG. 13 is a graph illustrating the relationship between the inter-peak voltage Vpp of the AC component of electric power supplied to the charging roll and the transfer current $I_{BTR}$ as gauged by the ammeter in a hot and highly humid environment.

Figure 13:
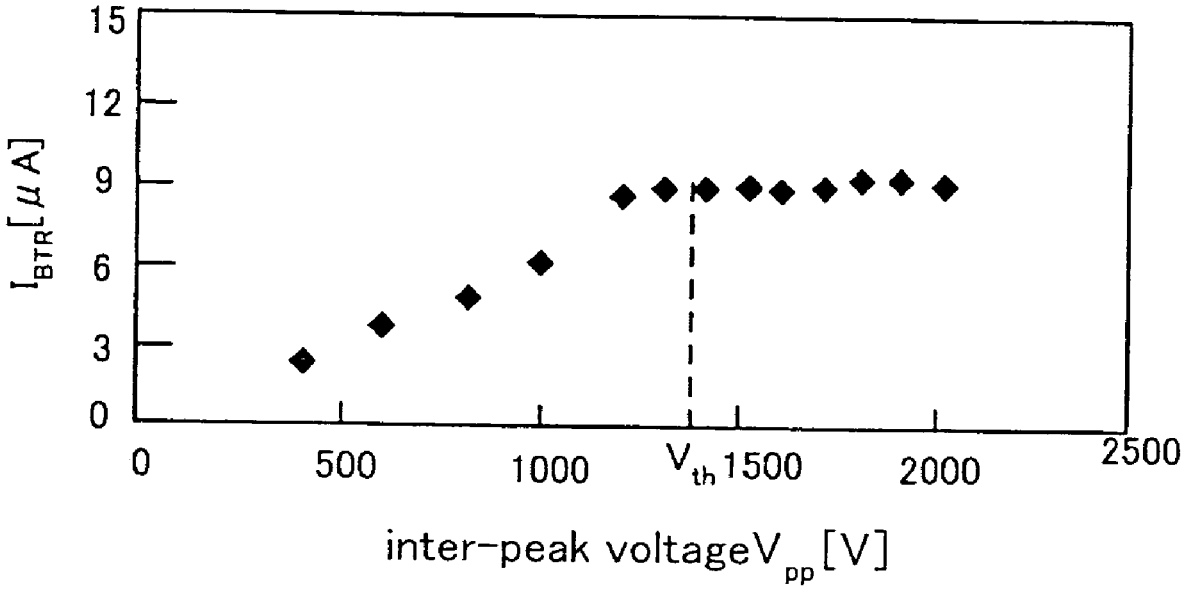
FIG. 13 is a graph illustrating the relationship between the inter-peak voltage Vpp of the AC component of electric power supplied to the charging roll and the transfer current $I_{BTR}$ as gauged by the ammeter in a hot and highly humid environment.

In each of the graphs of FIGS. 12 and 13, the horizontal axis represent the inter-peak voltage Vpp (V) of the AC component of electric power supplied to the charging roll and the vertical axis represents the electric current value $I_{BTR}$ (μA) of the transfer current.

In the process of verification, the electric current value $I_{BTR}$ of the transfer current as gauged by the ammeter was monitored while gradually increasing the inter-peak voltage Vpp of the AC component of electric power supplied to the charging roll. From the graph obtained as a result of the observation, it is clear that the inter-peak threshold voltage Vth can be determined from the electric current value $I_{BTR}$ of the transfer current regardless if the electric current value $I_{BTR}$ is observed in a cold (10° C.) and low humid (15%) environment or in a hot (28° C.) and highly humid (85%) environment.

Then, the inter-peak voltage is computationally determined (Step S14). More specifically, the voltage value for the margin as determined on the basis of the temperature and the humidity detected by the environment sensor 111 is added to the inter-peak threshold voltage Vth as determined in Step S13 in order to determine the inter-peak voltage Vpp of the AC component of electric power supplied to the charging roll 131. A large voltage value is selected for the margin when the surroundings of the photosensitive drums 11 show a cold and low humid environment.

With the above described embodiment of image forming apparatus, the electric current that is necessary for controlling the constant current source 132 shown in FIG. 2 is gauged by means of the ammeter 22 that is installed and used to control the transfer bias voltage so that no additional ammeter needs to be installed and hence the apparatus can be manufactured at relatively low cost. Additionally, with the above described embodiment, a lowest possible inter-peak threshold voltage Vth at which electric discharges take place uniformly on a stable basis is detected and subsequently the AC voltage that is superimposed on the DC voltage of the constant current source 132 is controlled according to the detected inter-peak threshold voltage Vth. Therefore, it is possible to reduce the margin to be added to the inter-peak threshold voltage Vth for the purpose of controlling the AC voltage can be reduced if compared with conventional apparatus where a fixed value is used for the inter-peak threshold voltage Vth so that the inter-peak voltage of the AC voltage can be held low. As a result, the photosensitive drums 11 are prevented from becoming degraded due to electric discharges and adherence of discharge products to the photosensitive drums 11 is minimized.

Now, the second embodiment of image forming apparatus according to the invention will be described below.

As in the case of the image forming apparatus 1 shown in FIG. 1, the image forming apparatus of this embodiment is also a full color tandem type image forming apparatus having four toner image forming units. The component members of the embodiment same as or similar to those of the image forming apparatus 1 of FIG. 1 are denoted respectively by the same reference symbols and only the characteristic parts of the image forming apparatus of the second embodiment will be described below.

Figure 14:
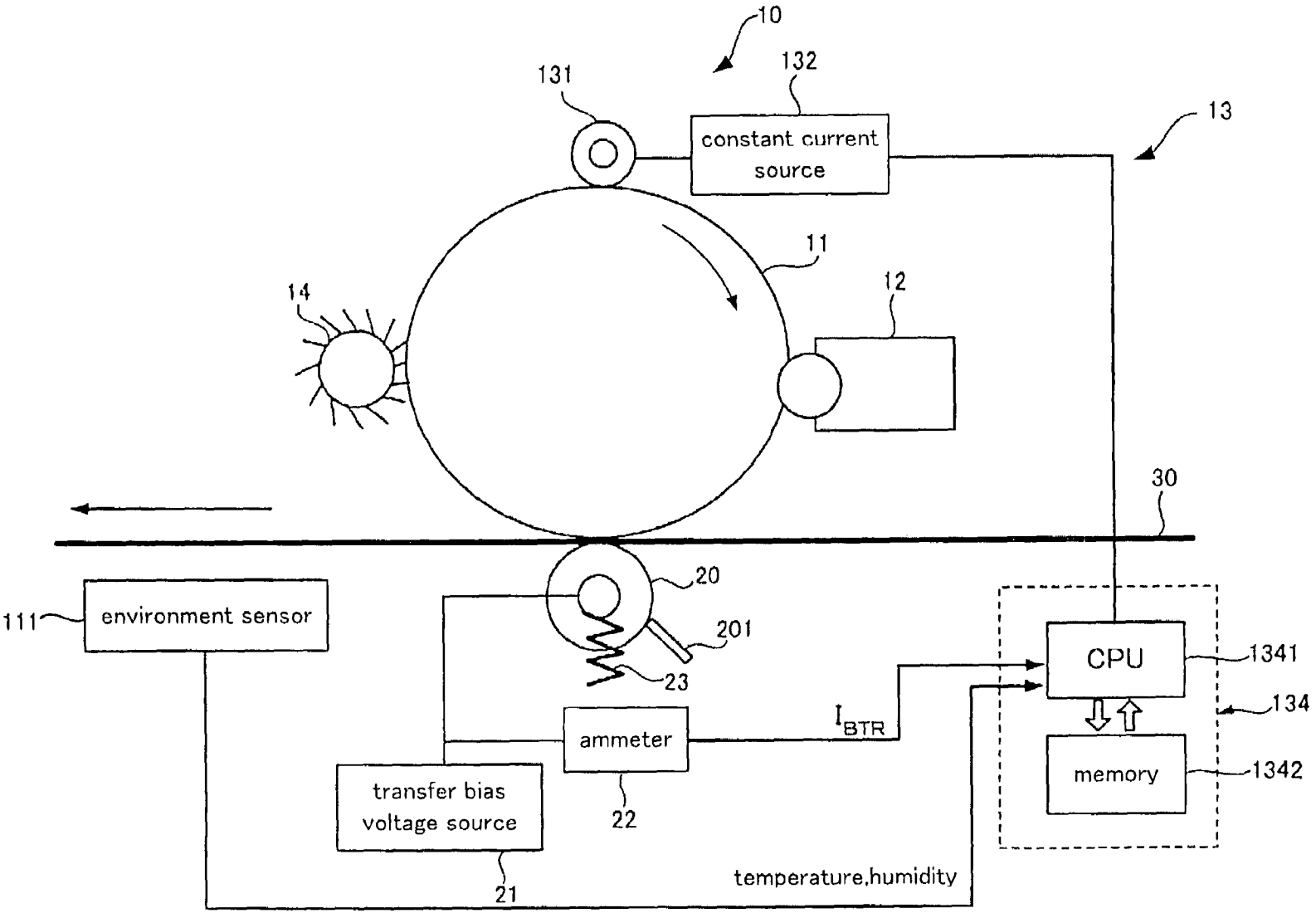
FIG. 14 is a schematic illustration of the characteristic aspects of the configuration of the second embodiment of image forming apparatus.

FIG. 14 is a schematic illustration of the characteristic aspects of the configuration of the second embodiment of image forming apparatus.

Like FIG. 2, FIG. 14 shows a toner image forming unit 10 having a photosensitive drum 11, a developing device 12, a contact type charging device 13 and a cleaning brush 14, a primary transfer roll 20 and part of an intermediary transfer belt 30. The second embodiment of image forming apparatus additionally has an urging unit 23 as shown in FIG. 14 that is adapted to push the primary transfer roll 20 against the surface of the photosensitive 11 with a constant load.

A transfer current flows to the primary transfer roll 20 shown in FIG. 14 by way of the intermediary transfer belt 30 due to the electric charge on the photosensitive drum 11 that is electrically charged by the charging roll 131. The transfer current is gauged by means of the ammeter 22 that is installed and used to control the transfer bias voltage.

If the nipping length of the nipping area that is produced when the photosensitive drum 11 and the intermediary transfer belt 30 are brought into contact with each other changes, the electric current value of the transfer current also changes. However, since the primary transfer roll 20 shown in FIG. 14 is pushed against the photosensitive drum 11 with a constant load by the urging unit 23, the nipping length is held unchanged so that the ammeter 22 can accurately gauge the transfer current.

The primary transfer roll 20 of FIG. 14 has a blade 201 that is adapted to contact the peripheral surface thereof. If the peripheral surface of the primary transfer roll 20 is stained by dirt, its electric resistance changes so that the ammeter 22 cannot accurately gauge the electric current value of the transfer current but the peripheral surface of the primary transfer roll 20 shown in FIG. 9 is cleaned by the blade. Therefore, the electric current value of the transfer current gauged by the ammeter 22 is not adversely influenced by the electric resistance changes in the second embodiment.

Figure 15:
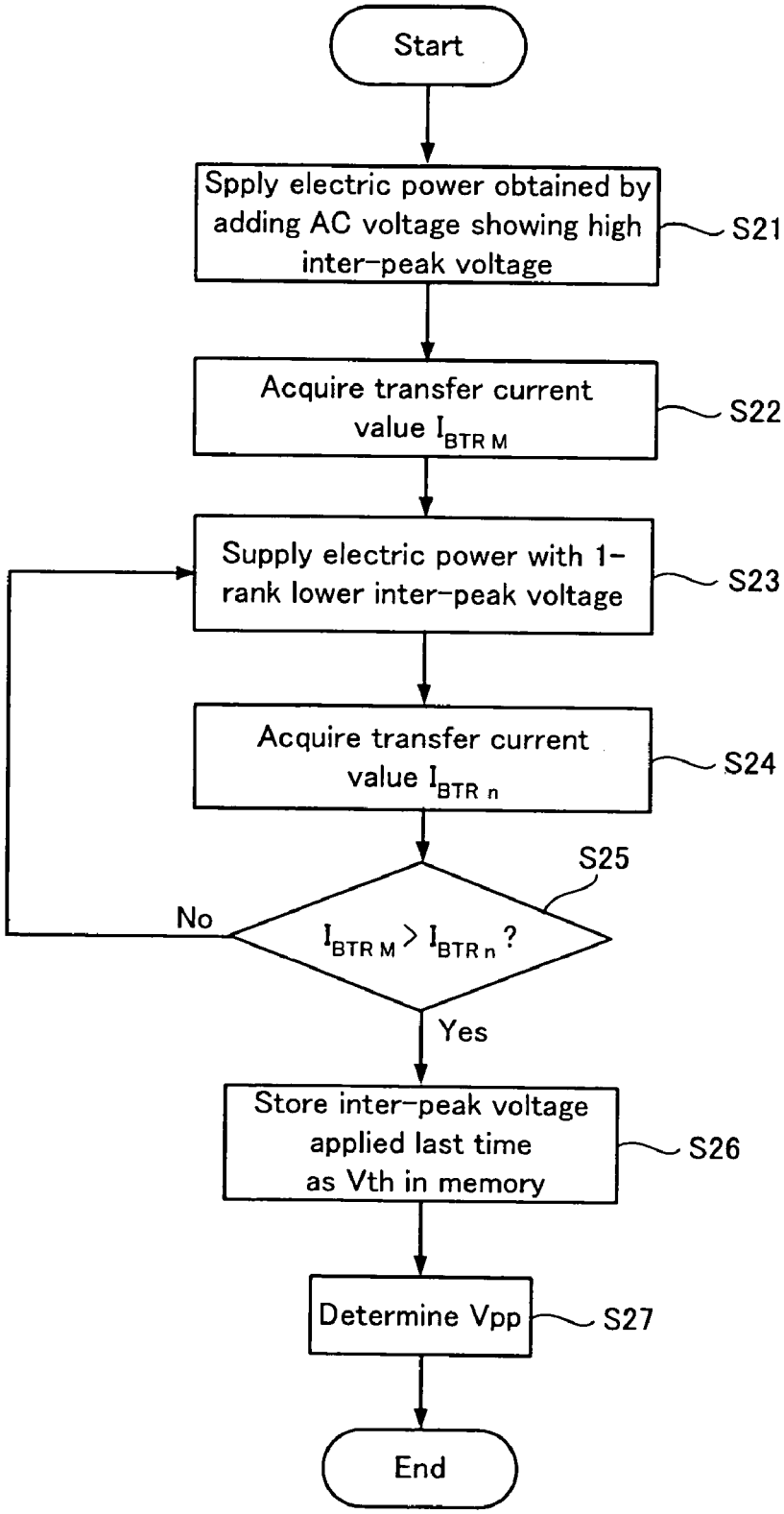
FIG. 15 is a flow chart of the arithmetic operation of determining the inter-peak voltage to be performed by the CPU of the constant current source control section shown in FIG. 14.

FIG. 15 is a flow chart of the arithmetic operation of determining the inter-peak voltage to be performed by the CPU of the constant current source control section shown in FIG. 14.

The arithmetic operation for determining the inter-peak voltage shown in FIG. 15 starts at a timing same as that of the start of the arithmetic operation for determining the inter-peak voltage shown in FIG. 10. Additionally, the arithmetic operation of FIG. 15 also starts in the time interval between two consecutive printing operations, or between two consecutively processed pages carrying respective images that are different from each other, whenever a predetermined period of time has elapsed.

The memory 1342 of the constant current source control section 134 shown in FIG. 14 stores the voltage value of the predetermined inter-peak voltage that is higher than twice of the discharge triggering voltage that starts uniform electric discharges on a stable basis as determined by means of the Paschen's law, which is the voltage value with which the surface electric potential Vh of the photosensitive body shown in FIG. 9 or the transfer current $I_{BTR}$ reliably saturates, and the voltage values at the points of equal division at which the span between the discharge triggering voltage and the predetermined inter-peak voltage is equally divided. In the arithmetic operation of FIG. 15, firstly the inter-peak threshold voltage Vth is determined by using the above described voltage values stored in the memory 1342.

Then, electric power showing a voltage waveform obtained by superimposing an AC voltage showing the predetermined inter-peak voltage stored in the memory 1342 on a predetermined DC voltage is supplied to the charging roll 131 from the constant current source 132 shown in FIG. 14 (Step S21).

Thereafter, the electric current value $I_{BTR\ M}$ of the transfer current that flows to the primary transfer roll 20 as a result of the power supply in Step S21 is acquired and stored in the memory 1342 (Step S22).

Subsequently, electric power showing a voltage waveform obtained by superimposing an AC voltage showing an inter-peak voltage equal to the voltage of the next lower point of equal division on the predetermined DC voltage is supplied to the charging roll 131 from the constant current source 132 (Step S23). The electric current value $I_{BTR\ n}$ of the transfer current that flows to the primary transfer roll 20 as a result of the power supply in Step S23 is acquired and stored in the memory 1342 (Step S24).

Then, it is judged if the electric current value $I_{BTR\ M}$ stored in the memory 1342 in Step S22 is greater than the electric current value $I_{BTR\ n}$ stored in the memory 1342 in Step S24 or not (Step S25). The result of the judgment is that the electric current value $I_{BTR\ M}$ is either greater than or equal to the electric current value $I_{BTR\ n}$ because the electric current value $I_{BTR}$ remains at a substantially same level if the inter-peak voltage Vpp of the AC voltage is raised above the inter-peak threshold voltage Vth (see FIGS. 7 through 9). The arithmetic operation returns to Step S23 if it is judged that the electric current value $I_{BTR\ M}$ is equal to the electric current value $I_{BTR}$ n, whereas the inter-peak voltage that was used at the time of acquiring the electric current value $I_{BTR\ n}$ stored in the memory 1342 in the immediately preceding Step S24 is selected as the inter-peak threshold voltage Vth and stored in the memory 1342 if it is judged that the electric current value $I_{BTR\ M}$ is greater than the electric current value $I_{BTR\ n}$ (Step S26).

Then, as in Step S14 of FIG. 10, the voltage value for the margin as determined on the basis of the temperature and the humidity detected by the environment sensor 111 is added to the inter-peak threshold voltage Vth stored in the memory 1342 in order to determine the inter-peak voltage Vpp of the AC component of electric power supplied to the charging roll 131 (Step S27).

Just like the constant current source control section 134 shown in FIG. 2, the constant current source control section 134 shown in FIG. 14 so controls the constant current source 132 that electric power showing a voltage waveform obtained by superimposing an AC voltage having an inter-peak voltage Vpp equal to the determined voltage value on a predetermined DC voltage is supplied from the constant current source 132 to the charging roll 131.

Now, the third embodiment of the present invention will be described below.

As in the case of the image forming apparatus 1 shown in FIG. 1, the image forming apparatus of this embodiment is a full color tandem type image forming apparatus having four toner image forming units. The component members of the embodiment same as or similar to those of the image forming apparatus 1 of FIG. 1 are denoted respectively by the same reference symbols and only the characteristic parts of the image forming apparatus of the third embodiment will be described below.

Figure 16:
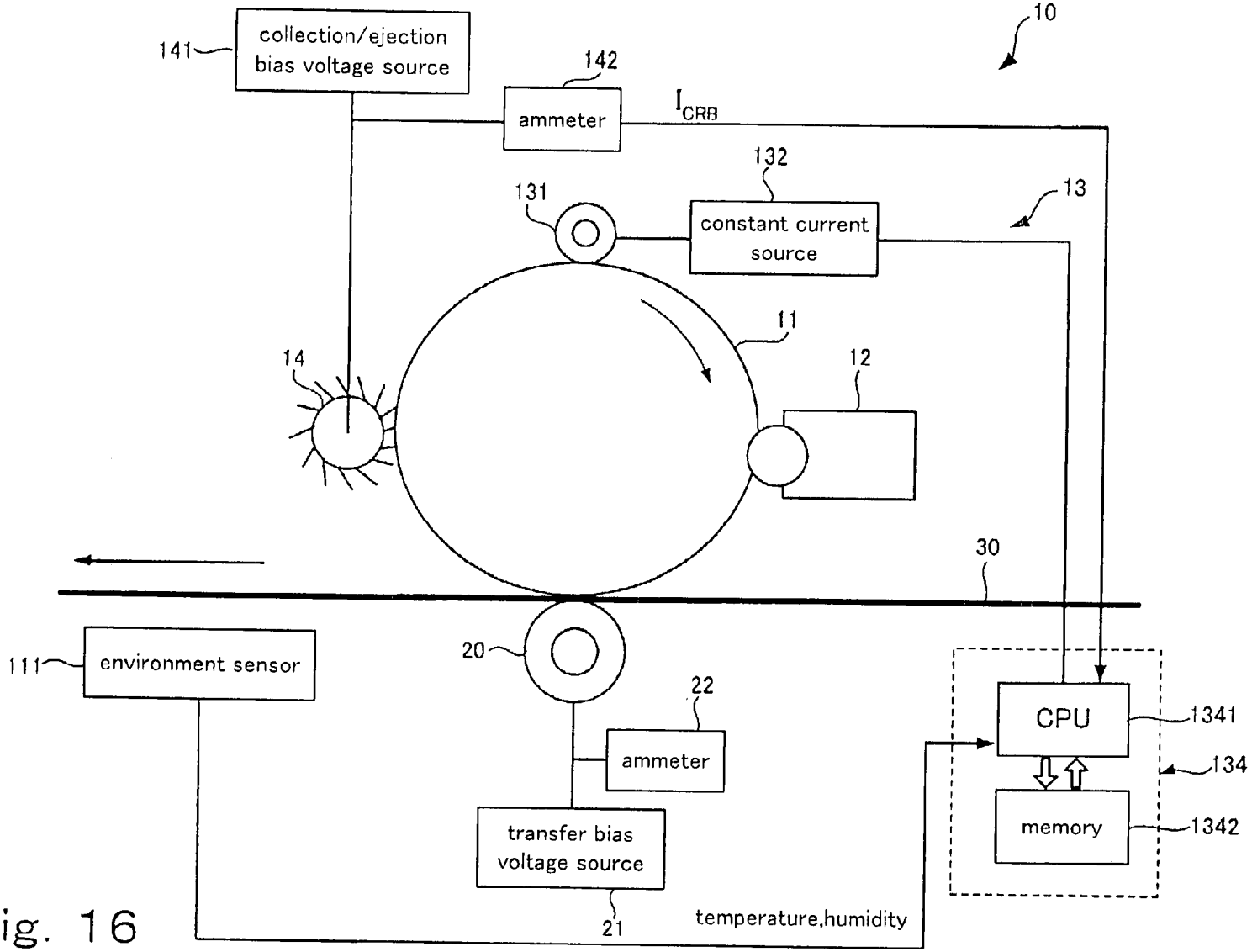
FIG. 16 is a schematic illustration of the characteristic aspects of the configuration of the third embodiment of image forming apparatus.

FIG. 16 is a schematic illustration of the characteristic aspects of the configuration of the third embodiment of image forming apparatus.

Like FIGS. 2 and 12, FIG. 16 shows a toner image forming unit 10, a primary transfer roll 20 and part of an intermediary transfer belt 30. The toner image forming unit 10 shown in FIG. 16 has a photosensitive drum 11, a developing device 12, a contact type charging device 13 and a cleaning brush 14 as in the case of the toner image forming unit shown in FIG. 2. FIG. 16 also shows that the third embodiment of image forming apparatus is provided with a collection/ejection bias voltage source 141 that is adapted to apply a collection bias voltage and an ejection bias voltage to the cleaning brush 14 and an ammeter 142 that is used for controlling the collection/ejection bias voltages that are supplied to the cleaning brush 14. The front end of the cleaning brush 14 is held in contact with the photosensitive drum 11 and an electric current is made to flow to the cleaning brush 14 due to the electric charge on the photosensitive drum 11 that is electrically charged by the charging roll 131 (to be referred to as cleaning current hereinafter). The cleaning current is gauged by the ammeter 142 that is used for controlling the collection/ejection bias voltages. In the third embodiment, the constant current source control section 134 shown in FIG. 16 acquires the electric current value $I_{CRB}$ of the cleaning current instead of the electric current value of the transfer current and detects the inter-peak threshold voltage Vth, using the acquired electric current value $I_{CRB}$. Then, the constant current source control section 134 controls the inter-peak voltage Vpp of the AC voltage that is added to a predetermined DC voltage of the constant current source 132 according to the detected inter-peak threshold voltage Vth.

Now, the fourth embodiment of the invention will be described below.

The fourth embodiment of image forming apparatus according to the invention is same as the third embodiment of image forming apparatus except that it has a toner charging control member 15 in place of the cleaning brush 14. As in the case of the third embodiment, the component members of the embodiment same as or similar to those of the image forming apparatus 1 of FIG. 1 are denoted respectively by the same reference symbols and only the characteristic parts of the image forming apparatus of the fourth embodiment will be described below.

Figure 17:
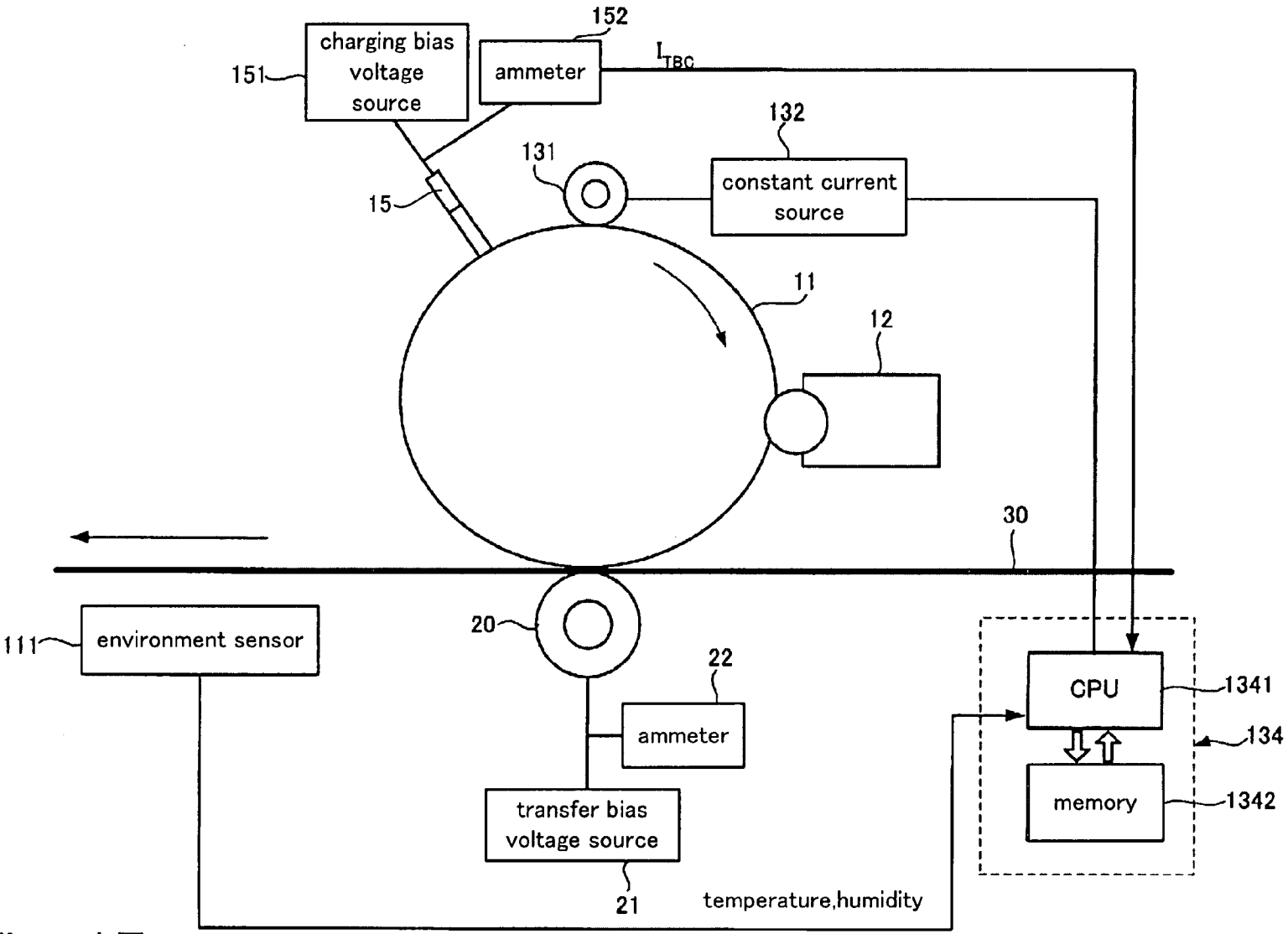
FIG. 17 is a schematic illustration of the characteristic aspects of the configuration of the fourth embodiment of image forming apparatus.

FIG. 17 is a schematic illustration of the characteristic aspects of the configuration of the fourth embodiment of image forming apparatus.

FIG. 17 shows a toner image forming unit 10, a primary transfer roll 20 and part of an intermediary transfer belt 30. The toner image forming unit 10 shown in FIG. 17 has a photosensitive drum 11, a developing device 12 and a contact type charging device 13 as in the case of the toner image forming unit shown in FIG. 16 along with a toner charging control member 15 that replaces the cleaning brush 14 of the toner image forming unit of FIG. 16 and is arranged close to the photosensitive drum 11 between the primary transfer roll 20 and the charging roll 131. The front end of the toner charging control member 15 is held in contact with the photosensitive drum 11. It is a member adapted to electrically uniformly charge the toner remaining on the photosensitive drum 11 with the same polarity in order to prevent the residual toner from adhering to the charging roll 131. The fourth embodiment of image forming apparatus additionally has a charging bias voltage source 151 adapted to apply a charging bias voltage to the toner charging control member 15 and an ammeter 152 that is used to control the charging bias voltage supplied to the toner charging control member 15. An electric current flows to the toner charging control member 151 due to the electric charge on the photosensitive drum 11 that is electrically charged by the charging roll 131 (to be referred to as toner charging current hereinafter). The toner charging current is gauged by the ammeter 152 that is used for controlling the charging bias voltage. In the fourth embodiment, the constant current source control section 134 shown in FIG. 17 acquires the electric current value $I_{TBC}$ of the toner charging current instead of the electric current value of the transfer current and detects the inter-peak threshold voltage Vth, using the acquired electric current value $I_{TBC}$. Then, the constant current source control section 134 controls the inter-peak voltage Vpp of the AC voltage that is superimposed on a predetermined DC voltage of the constant current source 132 according to the detected inter-peak threshold voltage Vth.

Now, the fifth embodiment of the invention will be described below.

While the first through fourth embodiments of image forming apparatus according to the invention are adapted to form a full color image by using four toner image forming units, the fifth embodiment of image forming apparatus is adapted to form a full color image by using a single toner image forming unit. The component members of the embodiment same as or similar to those of the image forming apparatus 1 of FIG. 1 are denoted respectively by the same reference symbols and only the characteristic parts of the image forming apparatus of the fifth embodiment will be described below.

Figure 18:
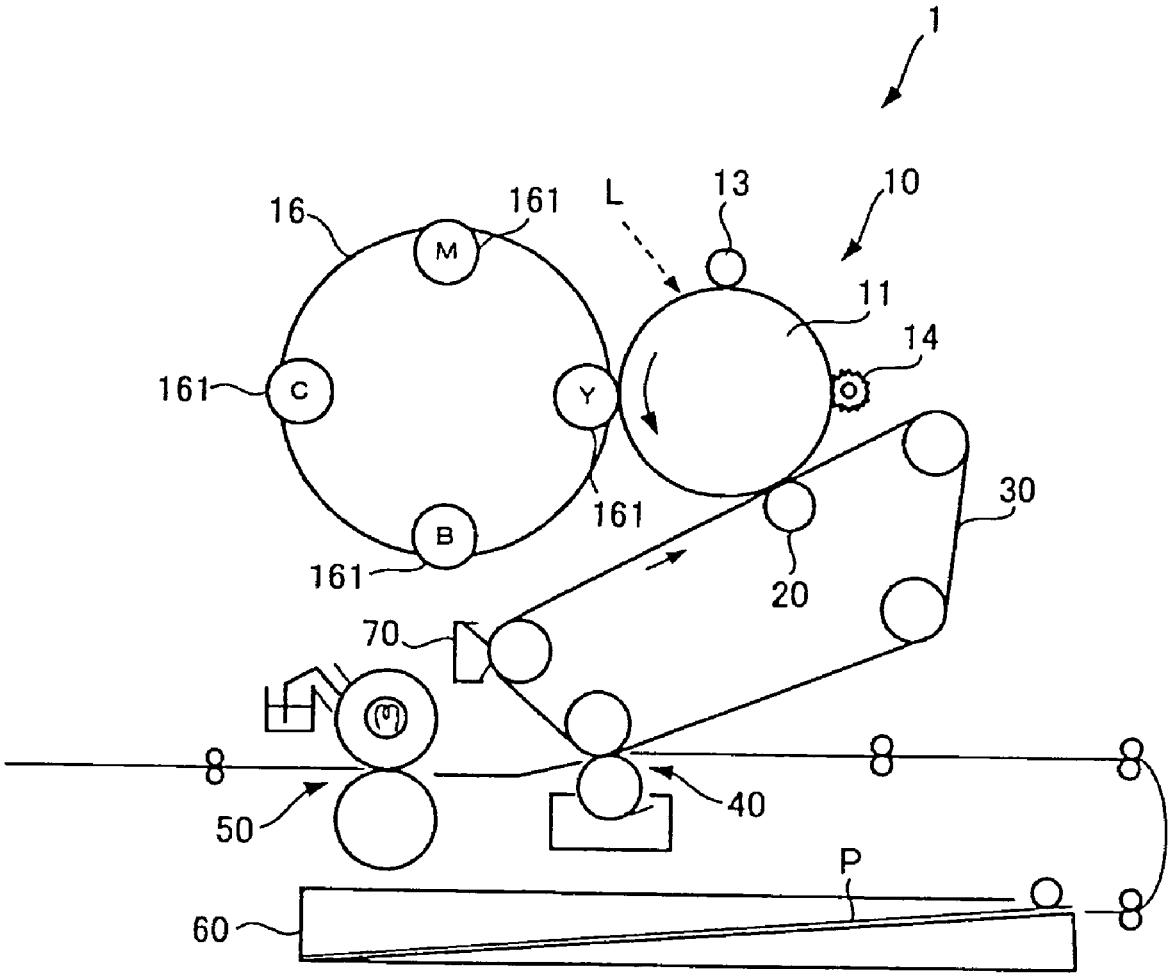
FIG. 18 is a schematic illustration of the configuration of the fifth embodiment of image forming apparatus.

FIG. 18 is a schematic illustration of the characteristic aspects of the configuration of the fifth embodiment of image forming apparatus.

The image forming apparatus 1 shown in FIG. 18 has only a single toner image forming unit 10. The toner image forming unit 10 by turn has a photosensitive drum 11, a contact type charging device 13 and a cleaning brush 14 along with a developing rotary unit 16. The developing rotary unit 16 is provided with developing devices 161 respectively containing color toners of yellow (Y), magenta (M), cyan (C) and black (B).

With the image forming apparatus 1 shown in FIG. 18, the surface of the photosensitive drum 11 is electrically uniformly charged by the contact type charging device 13 and subsequently a laser beam L is irradiated onto the surface of the photosensitive drum 11 according to a yellow image signal to form an electrostatic latent image on the surface of the photosensitive drum 11. Then, the electrostatic latent image formed on the surface of the photosensitive drum 11 is developed by means of the developing device 161 arranged at the developing rotary unit 16 and containing yellow toner to form a yellow toner image on the surface of the photosensitive drum 11. Then, the yellow toner image on the photosensitive drum 11 is transferred onto the intermediary transfer belt 30 as primary transfer operation by means of the primary transfer roll 20 at the primary transfer position where the photosensitive drum 11 and the intermediary transfer belt 30 are held in contact with each other. After the yellow toner image is transferred onto the intermediary transfer belt 30 as primary transfer operation, the residual toner on the surface of the photosensitive drum 11 is collected by the cleaning brush 14.

Subsequently, the developing rotary unit 16 is turned clockwise in FIG. 18 by 90° and a magenta toner image is formed on the surface of the photosensitive drum 11. Then, the magenta toner image is transferred onto the intermediary transfer belt 30 as primary transfer operation so as to be laid exactly on the yellow toner image that has been transferred in the primary transfer operation.

Similarly, a cyan toner image and a black toner image are sequentially formed and transferred so as to be laid exactly on the toner images that has been transferred in the primary transfer operations. With this arrangement, a single full color toner image is formed on the intermediary transfer belt 20 by sequentially laying the yellow, magenta, cyan and black images in the mentioned order as viewed from the surface of the intermediary transfer belt.

Then, as in the case of the image forming apparatus shown in FIG. 1, the single full color toner image on the intermediary transfer belt 30 that is formed by laying four toner images one on the other is collectively transferred onto the sheet of paper P fed from the sheet tray 60 by means of the collective transfer device 40 and the toner image transferred onto the sheet of paper P is fixed to the sheet P by means of the fixing device 50.

As in the case of the image forming apparatus shown in FIG. 1, a so-called cleanerless system, from which the cleaning blade adapted to contact the photosensitive drum 11 is omitted, is adopted in the image forming apparatus 1 of FIG. 18 and a belt cleaner 70 is provided to remove the toner remaining on the intermediary transfer belt 30.

Like the contact type charging device 13 shown in FIG. 2, the contact type charging device 13 of FIG. 18 has a charging roll 131, a constant current source 132 and a constant current source control section 134, of which the constant current source control section 134 has a CPU 1341 and a memory 1342. Like the image forming apparatus of the first embodiment, the image forming apparatus 1 of the fifth embodiment additionally has a transfer bias voltage source 21 for supplying a transfer bias voltage to the primary transfer roll 20, an ammeter 22 to be used for controlling the transfer bias voltage supplied to the primary transfer roll 20 and an environment sensor 111 for detecting the temperature and the humidity of the surroundings of the photosensitive drum 11.

Figure 19:
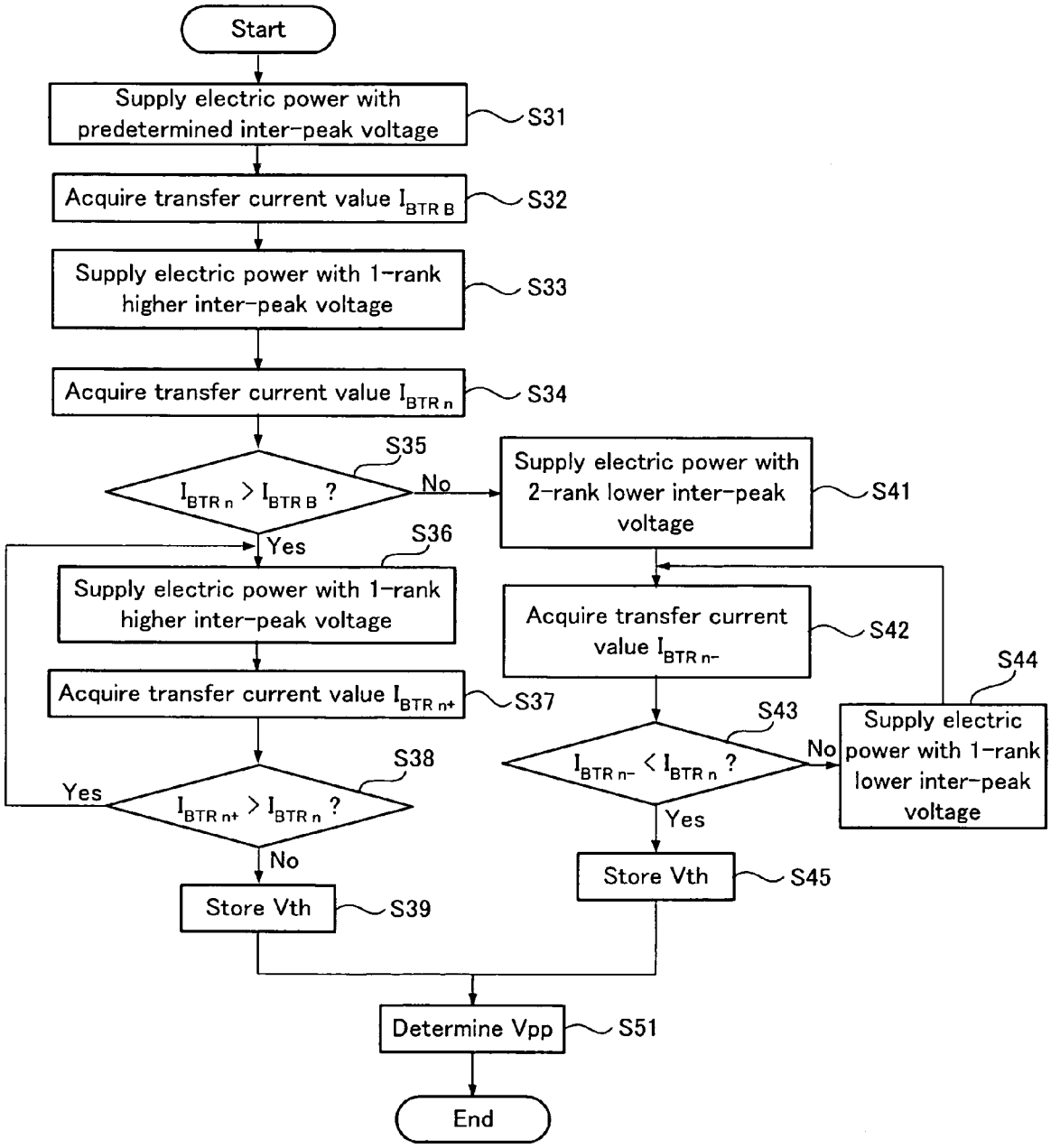
FIG. 19 is a flow chart of the arithmetic operation of determining the inter-peak voltage to be performed by the CPU of the constant current source control section included in a contact type charging device in FIG. 18.

FIG. 19 is a flow chart of the arithmetic operation of determining the inter-peak voltage to be performed by the CPU of the constant current source control section included in a contact type charging device in FIG. 18.

The arithmetic operation of determining the inter-peak voltage shown in FIG. 19 starts at a timing same as the one described above for the arithmetic operation of determining the inter-peak voltage by referring to FIG. 10.

The memory 1342 of the constant current source control section 134 of this embodiment stores the voltage value of the predetermined inter-peak voltage that is lower than twice of the discharge triggering voltage that starts uniform electric discharges on a stable basis as determined by means of the Paschen's law and plural voltage values arranged at regular intervals above and below the voltage value of the predetermined inter-peak voltage as so many ranks. The voltage value of the predetermined inter-peak voltage may be greater than twice of the discharge triggering voltage if it is found near the voltage value that is twice of the discharge triggering voltage as determined by means of the Paschen's law. In the arithmetic operation shown in FIG. 19, the inter-peak threshold voltage Vth is firstly determined by using the voltage values stored in the memory 1342.

Then, electric power showing a voltage waveform obtained by superimposing an AC voltage showing the predetermined inter-peak voltage stored in the memory 1342 on a predetermined DC voltage is supplied to the charging roll 131 from the constant current source 132 (Step S31).

Thereafter, the electric current value $I_{BTR\ B}$ of the transfer current that flows to the primary transfer roll 20 as a result of the power supply in Step S31 is acquired and stored in the memory 1342 (Step S32).

Subsequently, electric power obtained by superimposing an AC voltage showing an inter-peak voltage equal to the inter-peak voltage higher than the predetermined inter-peak voltage by one rank is supplied to the charging roll 131 from the constant current source 132 (Step S33). The electric current value $I_{BTR\ n}$ of the transfer current that flows to the primary transfer roll 20 as a result of the power supply in Step S33 is acquired and stored in the memory 1342 (Step S34).

Then, it is judged if the electric current value $I_{BTR\ n}$ stored in the memory 1342 in Step S34 is greater than the electric current value $I_{BTR\ B}$ stored in the memory 1342 in Step S32 or not (Step S35). The result of the judgment is that the electric current value $I_{BTR\ n}$ is either greater than or equal to the electric current value $I_{BTR\ B}$ because the electric current value $I_{BTR}$ linearly rises until the inter-peak voltage Vpp of the AC voltage is raised to the inter-peak threshold voltage Vth (see FIGS. 7 through 9).

If it is judged in Step S35 that the electric current value $I_{BTR\ n}$ is greater than the electric current value $I_{BTR\ B}$, electric power obtained by superimposing an AC voltage having an inter-peak voltage stored in the memory 1342 that is higher than the immediately preceding inter-peak voltage by one rank is supplied to the charging roll 131 from the constant current source 132 (Step S36) and the electric current value $I_{BTR\ n+}$ of the transfer current that flows to the primary transfer roll 20 as a result of the power supply in Step S36 is acquired and stored in the memory 1342 (Step S37). Then, it is judged if the electric current value $I_{BTR\ n+}$ stored in Step S37 is higher than the electric current value $I_{BTR\ n}$ stored in the memory 1342 immediately before or not (Step S38). If it is so, the arithmetic operation returns to Step S36. If it is not, the inter-peak voltage that was used when the electric current value $I_{BTR\ n}$ was acquired and stored in the memory 1342 immediately before is stored in the memory 1342 as inter-peak threshold voltage Vth (Step S39).

On the other hand, if it is judged in Step S35 that the electric current value $I_{BTR\ n}$ is equal to the electric current value $I_{BTR\ B}$, the predetermined inter-peak voltage that was used may well be stored in the memory 1342 as inter-peak threshold voltage Vth because a voltage value lower than twice of the discharge triggering voltage obtained by means of the Paschen's law was used as voltage value of the predetermined inter-peak voltage, considering the fact that the predetermined inter-peak voltage comes close to matching the inter-peak threshold voltage. However, the arithmetic operation may be continued in a manner as described below for the sake of precaution. The following processing operation corresponds to a processing operation that is conducted in a state where the electric current value $I_{BTR}$ of the transfer current remains substantially at a constant level because an inter-peak voltage Vpp of AC voltage higher than the inter-peak threshold voltage Vth is used (see FIGS. 7 through 9).

Firstly, in Step S41, electric power obtained by superimposing an AC voltage having an inter-peak voltage whose voltage value is stored in the memory 1342 that is lower than the predetermined inter-peak voltage by two ranks is supplied to the charging roll 131 from the constant current source 132 and the electric current value $I_{BTR\ n-}$ of the transfer current that flows to the primary transfer roll 20 as a result of the power supply in Step S41 is acquired and stored in the memory 1342 (Step S42). Then, it is judged if the electric current value $I_{BTR\ n-}$ stored in Step S42 is lower than the electric current value $I_{BTR\ n}$ stored in the memory 1342 immediately before or not (Step S43). If it is judged in Step S42 that the electric current value $I_{BTR\ n-}$ is equal to the electric current value $I_{BTR\ n}$, electric power obtained by superimposing an AC voltage having an inter-peak voltage stored in the memory 1342 that is lower than the immediately preceding inter-peak voltage by one rank is supplied to the charging roll 131 from the constant current source 132 (Step S44) and the processing operation returns to Step S42. If, on the other hand, it is judged in Step S43 that the electric current value $I_{BTR\ n-}$ is lower than the electric current value $I_{BTR\ n}$, the inter-peak voltage that was used when the electric current value $I_{BTR\ n}$ was acquired and stored in the memory 1342 immediately before is stored in the memory 1342 as inter-peak threshold voltage Vth (Step S45).

Then, as in Step S14 of FIG. 10, the voltage value for the margin as determined on the basis of the temperature and the humidity detected by the environment sensor 111 is added to the inter-peak threshold voltage Vth stored in the memory 1342 in order to determine the inter-peak voltage Vpp of the AC component of electric power supplied to the charging roll 131 (Step S51).

Now, the sixth embodiment of the invention will be described below.

While the above described first through fifth embodiments of image forming apparatus are adapted to form a full color image, the sixth embodiment of image forming apparatus is adapted to form a monochromatic image. Here again, the component members of the embodiment same as or similar to those of the image forming apparatus 1 of FIG. 1 are denoted respectively by the same reference symbols and only the characteristic parts of the image forming apparatus of the sixth embodiment will be described below.

Figure 20:
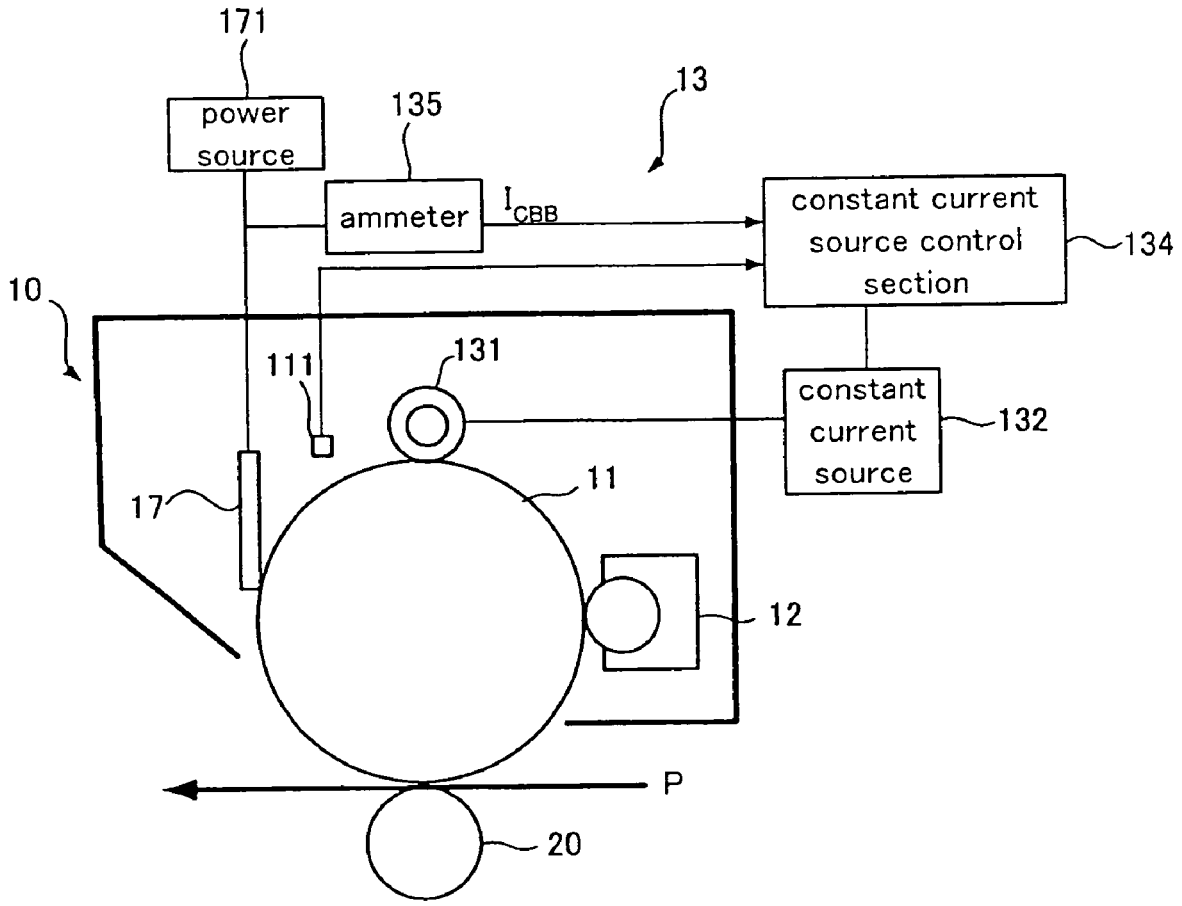
FIG. 20 is a schematic illustration of the characteristic aspects of the configuration of the sixth embodiment of image forming apparatus.

FIG. 20 is a schematic illustration of the characteristic aspects of the configuration of the sixth embodiment of image forming apparatus.

FIG. 20 shows a toner image forming unit 10, a primary transfer roll 20 and an environment sensor 111 that the sixth embodiment of image forming apparatus has. The toner image forming unit 10 by turn has a photosensitive drum 11, a developing device 12 and a contact type charging device 13. As in the case of the contact type charging device 13 of FIG. 2, the contact type charging device 13 has a charging roll 131, a constant current source 132 and a constant current source control section 134. The toner image forming unit 10 of FIG. 20 is provided with a cleaning blade 17 in place of the cleaning brush 14 shown in FIG. 2. The front end of the cleaning blade 17 is held in contact with the photosensitive drum 11. The cleaning blade 17 is adapted to remove the toner remaining on and the discharge products adhering to the surface of the photosensitive drum 11. This embodiment of image forming apparatus also has a power source 171 that applies a charging bias voltage to the cleaning blade 17. An electric current flows to the cleaning blade 17 due to the electric charge on the photosensitive drum 11 that is electrically charged by the charging roll 131 (to be referred to as blade charging current hereinafter). The contact type charging device 13 is provided with an ammeter 135' that gauges the electric current value $I_{CBB}$ of the blade charging current. In this embodiment, the constant current source control section 134 acquires the electric current value $I_{CBB}$ of blade charging current and detects the inter-peak threshold voltage Vth by means of the acquired electric current value $I_{CBB}$. Then, the constant current source control section 134 controls the inter-peak voltage Vpp of the AC voltage that is supreimposed on the predetermined DC voltage of the constant current source 132 according to the detected inter-peak threshold voltage Vth.

The intermediary transfer belt 30 and the collective transfer device 40 shown in FIG. 1 are omitted from the sixth embodiment of image forming apparatus and the toner image formed on the photosensitive drum 11 is transferred onto a sheet of paper P by the primary transfer roll 20 shown in FIG. 20.

What is claimed is:

1. A charging device that electrically charges a charged object charged while being moved in a predetermined direction comprising:

a charging member that electrically charges the charged object;

a power source adapted to supply the charging member with an electric power showing a voltage waveform obtained by superimposing an AC voltage on a DC voltage;

a contact member arranged downstream relative to the charging member as viewed in the moving direction of the charged object and adapted to contact the charged object directly or by way of a predetermined intermediary medium;

an ammeter that gauges an electric current caused to flow through the contact member due to an electric charge on the charged object electrically charged by the charging member; and a power source control section adapted to control the electric current of the AC component supplied to the charging member by the power source on the basis of the electric current gauged by the ammeter.

2. A device according to claim 1, wherein the power source control section is adapted to control an inter-peak voltage of the AC voltage supplied to the charging member by the power source on the basis of the electric current gauged by the ammeter.

3. A device according to claim 1, wherein the power source is a constant current source.

4. A device according to claim 1, wherein the charging member is a contact charging member being adapted to electrically charge the charged object in a state where the charging member contacts the charged object.

5. A device according to claim 1, wherein the power source supplies electric power showing a voltage waveform obtained by superimposing an AC voltage on a DC voltage to the charging member, wherein the charged object has a characteristic that the charged voltage rises substantially linearly to a predetermined inter-peak threshold voltage as the inter-peak voltage of the AC voltage increases and remains substantially at a constant level when the inter-peak voltage of the AC voltage exceeds the predetermined inter-peak threshold voltage, and wherein the power source control section detects the inter-peak threshold voltage on the basis of the electric current gauged by the ammeter and controls the AC voltage being superimposed on the DC voltage of the power source on the basis of the inter-peak threshold voltage.

6. A device according to claim 5, wherein the power source control section determines the inter-peak threshold voltage on the basis of at least three electric current values including a first and a second electric current values each of which acquired by sequentially superimposing on a predetermined DC voltage at least two AC voltages showing respective peak voltages that are lower than the inter-peak threshold voltage and different from each other and gauging the electric current values by means of the ammeter when the AC voltages are superimposed and a third electric current value acquired by superimposing on the predetermined DC voltage at least one AC voltage showing an inter-peak voltage exceeding the above inter-peak threshold voltage and gauging the electric current value by means of the ammeter.

7. A device according to claim 5, wherein when the power source control section acquires an electric current value by superimposing on the predetermined DC voltage an AC voltage showing an inter-peak voltage exceeding the inter-peak threshold voltage and gauging the electric current value by means of the ammeter, the power source control section determines the inter-peak threshold voltage while gradually lowering the inter-peak voltage.

8. A device according to claim 5, wherein when the power source control section acquires an electric current value by superimposing on the predetermined DC voltage an AC voltage showing an inter-peak voltage that is lower than the inter-peak threshold voltage and gauging the electric current value by means of the ammeter, the power source control section determines the inter-peak threshold voltage while gradually raising the inter-peak voltage.

9. An image forming apparatus adapted to form a fixed toner image on a recording medium by way of a process of electrically charging a photosensitive body being moved in a predetermined moving direction and producing an electrostatic latent image on the photosensitive body when being exposed to light so as to carry a toner image as a result of developing the electrostatic latent image and ultimately by transferring the toner image onto the recording medium and fixing the transferred image, the image forming apparatus comprising:

a charging member that electrically charges the photosensitive body;

a power source adapted to supply an electric power showing a voltage waveform obtained by superimposing an AC voltage on a DC voltage to the charging member a contact member arranged downstream relative to the charging member as viewed in the moving direction of the photosensitive body and adapted to contact the photosensitive body directly or by way of a predetermined intermediary medium;

an ammeter that gauges an electric current caused to flow through the contact member due to the electric charge on the photosensitive body electrically charged by the charging member and moved to the position contacting the contact member without effectuating exposure and development; and a power source control section that controls the electric current of the AC component supplied to the charging member by the power source on the basis of the electric current gauged by the ammeter.

10. An apparatus according to claim 9, wherein the power source control section controls an inter-peak voltage of the AC voltage supplied to the charging member by the power source on the basis of the electric current gauged by the ammeter.

11. An apparatus according to claim 10, further comprising an environment detection unit that detects the temperature and the humidity of the surroundings of the photosensitive body, wherein the power source control section is adapted to amend the inter-peak voltage on the basis of the temperature and the humidity detected by the environment detection unit when controlling the inter-peak voltage of the AC voltage.

12. An apparatus according to claim 9, wherein the power source is a constant current source.

13. An apparatus according to claim 9, wherein the charging member is a contact charging member adapted to electrically charge the photosensitive body in a state where the charging member contacts the photosensitive body.

14. An apparatus according to claim 9, further comprising a transfer member arranged at a transfer position located downstream relative to the charging member as viewed in the moving direction of the photosensitive body and adapted to contact the photosensitive body directly or by way of a predetermined intermediary medium in order to transfer the toner image formed on the photosensitive body onto a predetermined object of transfer, wherein the transfer member operates as the contact member.

15. An apparatus according to claim 14, wherein the transfer member is a transfer roll.

16. An apparatus according to claim 15, wherein the transfer roll is provided with a blade adapted to contact the peripheral surface of the transfer roll.

17. An apparatus according to claim 15, wherein the transfer roll is pressed against the surface of the photosensitive body with a constant load.

18. An apparatus according to claim 9, further comprising:

a transfer member arranged at a transfer position located downstream relative to the charging member as viewed in the moving direction of the photosensitive body and adapted to contact the photosensitive body directly or by way of the predetermined intermediary medium in order to transfer the toner image formed on the photosensitive body onto a predetermined object of transfer;

a rotary brush arranged downstream relative to the transfer position and adapted to contact the photosensitive body; and a voltage applying section adapted to apply a collection voltage collecting the toner remaining on the photosensitive body to the rotary brush and also apply an ejection voltage causing the rotary brush to eject the collected toner onto the photosensitive body at a predetermined timing, wherein the rotary brush operates as the contact member.

19. An apparatus according to claim 9, further comprising:

a transfer member arranged at a transfer position located downstream relative to the charging member as viewed in the moving direction of the photosensitive body and adapted to contact the photosensitive body directly or by way of a predetermined intermediary transfer body in order to transfer the toner image formed on the photosensitive body onto a predetermined object of transfer; and a cleaning blade arranged downstream relative to the transfer position and adapted to contact the photosensitive body in order to remove the toner remaining on the photosensitive body, wherein the cleaning blade operates as the contact member.

20. An apparatus according to claim 9, further comprising:

a transfer member arranged at a transfer position located downstream relative to the charging member as viewed in the moving direction of the photosensitive body and adapted to contact the photosensitive body directly or by way of a predetermined intermediary transfer body in order to transfer the toner image formed on the photosensitive body onto a predetermined object of transfer; and a toner charging control member arranged downstream relative to the transfer position and adapted to contact the photosensitive body in order to electrically charge the toner remaining on the photosensitive body, wherein the toner charging control member operates as the contact member.

21. An apparatus according to claim 9, comprising a plurality of photosensitive bodies that form respective toner images in different colors to produce a full color image.

22. An apparatus according to claim 9, wherein the power source is adapted to supply electric power showing a voltage waveform obtained by superimposing an AC voltage on a DC voltage to the charging member, wherein the photosensitive body has a characteristic that the charged voltage rises substantially linearly to a predetermined inter-peak threshold voltage as the inter-peak voltage of the AC voltage increases and remains substantially at a constant level when the inter-peak voltage of the AC voltage exceeds the predetermined inter-peak threshold voltage, and wherein the power source control section detects the inter-peak threshold voltage on the basis of the electric current gauged by the ammeter and controls the AC voltage being superimposed on the DC voltage of the power source on the basis of the inter-peak threshold voltage.

23. An apparatus according to claim 9, wherein the ammeter is adapted to gauge the electric current caused to flow by the electric charge of the photosensitive body that is electrically charged by the charging member between an image forming process and the next image forming process out of a plurality of consecutive image forming processes.

* * * * *